United States Patent [19]

Watanabe

[11] Patent Number: 4,666,288

[45] Date of Patent: May 19, 1987

[54] IMAGE FORMING APPARATUS WITH AREA SELECTION AND CONFIRMATION

[75] Inventor: Junji Watanabe, Yokohama, Japan

[73] Assignee: Kabushiki Kaisha Toshiba, Kawasaki, Japan

[21] Appl. No.: 819,690

[22] Filed: Jan. 17, 1986

[30] Foreign Application Priority Data

Jan. 18, 1985 [JP] Japan ..... 60-6760
Mar. 7, 1985 [JP] Japan ..... 60-45140
Apr. 24, 1985 [JP] Japan ..... 60-87756

[51] Int. Cl.[4] ..... G03G 15/22

[52] U.S. Cl. ..... 355/14 R; 355/7; 358/300

[58] Field of Search ..... 355/3 R, 4, 6, 7, 8, 355/14 R, 14 C, 14 E; 358/298, 300

[56] References Cited

U.S. PATENT DOCUMENTS 3,827,799 8/1974 Koizumi ..... 355/7 X
3,997,873 12/1976 Thornton ..... 355/6
4,045,218 8/1977 McVeigh ..... 355/7 X
4,157,822 6/1979 Miller ..... 355/6 X
4,215,929 8/1980 Sato et al. ..... 355/7
4,256,400 3/1981 Komori et al. ..... 355/7 X
4,417,805 11/1983 Kishi ..... 355/14 R
4,595,273 6/1986 Watanabe et al. ..... 355/14 R X

FOREIGN PATENT DOCUMENTS 3341744 5/1984 Fed. Rep. of Germany .
3538052 4/1986 Fed. Rep. of Germany .
3545081 7/1986 Fed. Rep. of Germany .

*Primary Examiner*—Fred L. Braun

*Attorney, Agent, or Firm*—Finnegan, Henderson, Farabow, Garrett & Dunner

[57] ABSTRACT

An image forming apparatus with area selection and confirmation the apparatus including an original table, a transmission light emitting section, provided movably along the original table, for emitting transmission light through the original placed on the original table, an erasure area specifying section for shifting the light emitted from the transmission light emitting section to an unnecessary portion of the original so as to specify a portion to be erased, an erasure area storage section for storing position data indicating the erasure portion specified by the erasure area specifying section, a checking operation designating section for designating a predetermined checking operation including confirmation of the erasure area specified by the erasure area specifying section, a first control section for reading out the position data stored in the erasure area storage section upon designation of the checking operation designating section and for supplying to the transmission light emitting section a control signal for the predetermined checking operation, including confirmation of the specified erasure area based on the readout position data, an original scanning section, an image forming section, an image erasing section for selectively erasing an image to be formed by the image forming section, and a second control section for reading out the position data stored in the erasure area storage section during an image forming operation of the image forming section so as to supply the readout data to the image erasing section.

12 Claims, 37 Drawing Figures

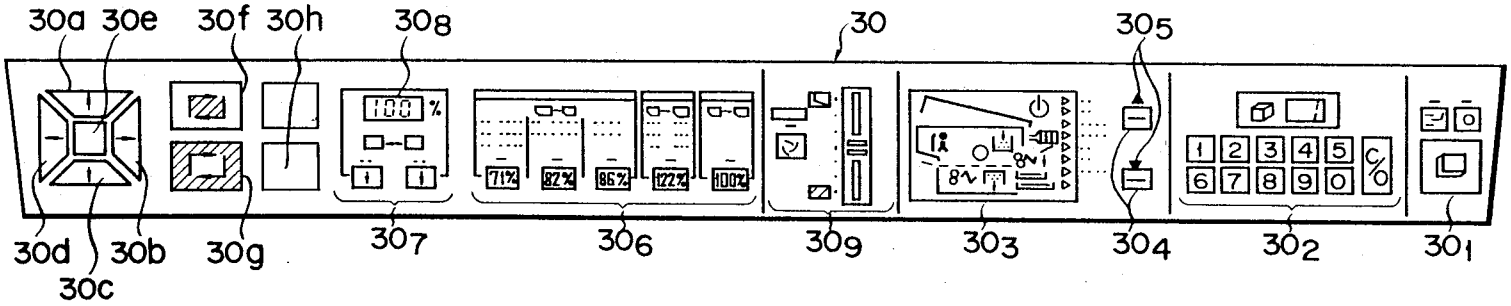
30
30a
30b
30c
30d
30e
30f
30g
30h
30i
30j
30k
30l
30m
30n
30o
30p
30q
30r
30s
30t
30u
30v
30w
30x
30y
30z
30aa
30ab
30ac
30ad
30ae
30af
30ag
30ah
30ai
30aj
30ak
30al
30am
30an
30ao
30ap
30aq
30ar
30as
30at
30au
30av
30aw
30ax
30ay
30az
30ba
30bb
30bc
30bd
30be
30bf
30bg
30bh
30bi
30bj
30bk
30bl
30bm
30bn
30bo
30bp
30bq
30br
30bs
30bt
30bu
30bv
30bw
30bx
30by
30bz
30ca
30cb
30cc
30cd
30ce
30cf
30cg
30ch
30ci
30cj
30ck
30cl
30cm
30cn
30co
30cp
30cq
30cr
30cs
30ct
30cu
30cv
30cw
30cx
30cy
30cz
30da
30db
30dc
30dd
30de
30df
30dg
30dh
30di
30dj
30dk
30dl
30dm
30dn
30do
30dp
30dq
30dr
30ds
30dt
30du
30dv
30dw
30dx
30dy
30dz
30ea
30eb
30ec
30ed
30ee
30ef
30eg
30eh
30ei
30ej
30ek
30el
30em
30en
30eo
30ep
30eq
30er
30es
30et
30eu
30ev
30ew
30ex
30ey
30ez
30fa
30fb
30fc
30fd
30fe
30ff
30fg
30fh
30fi
30fj
30fk
30fl
30fm
30fn
30fo
30fp
30fq
30fr
30fs
30ft
30fu
30fv
30fw
30fx
30fy
30fz
30ga
30gb
30gc
30gd
30ge
30gf
30gg
30gh
30gi
30gj
30gk
30gl
30gm
30gn
30go
30gp
30gq
30gr
30gs
30gt
30gu
30gv
30gw
30gx
30gy
30gz
30ha
30hb
30hc
30hd
30he
30hf
30hg
30hh
30hi
30hj
30hk
30hl
30hm
30hn
30ho
30hp
30hq
30hr
30hs
30ht
30hu
30hv
30hw
30hx
30hy
30hz
30ia
30ib
30ic
30id
30ie
30if
30ig
30ih
30ii
30ij
30ik
30il
30im
30in
30io
30ip
30iq
30ir
30is
30it
30iu
30iv
30iw
30ix
30iy
30iz
30ja
30jb
30jc
30jd
30je
30jf
30jg
30jh
30ji
30jj
30jk
30jl
30jm
30jn
30jo
30jp
30jq
30jr
30js
30jt
30ju
30jv
30jw
30jx
30jy
30jz
30ka
30kb
30kc
30kd
30ke
30kf
30kg
30kh
30ki
30kj
30kk
30kl
30km
30kn
30ko
30kp
30kq
30kr
30ks
30kt
30ku
30kv
30kw
30kx
30ky
30kz
30la
30lb
30lc
30ld
30le
30lf
30lg
30lh
30li
30lj
30lk
30ll
30lm
30ln
30lo
30lp
30lq
30lr
30ls
30lt
30lu
30lv
30lw
30lx
30ly
30lz
30ma
30mb
30mc
30md
30me
30mf
30mg
30mh
30mi
30mj
30mk
30ml
30mm
30mn
30mo
30mp
30mq
30mr
30ms
30mt
30mu
30mv
30mw
30mx
30my
30mz
30na
30nb
30nc
30nd
30ne
30nf
30ng
30nh
30ni
30nj
30nk
30nl
30nm
30nn
30no
30np
30nq
30nr
30ns
30nt
30nu
30nv
30nw
30nx
30ny
30nz
30oa
30ob
30oc
30od
30oe
30of
30og
30oh
30oi
30oj
30ok
30ol
30om
30on
30oo
30op
30oq
30or
30os
30ot
30ou
30ov
30ow
30ox
30oy
30oz
30pa
30pb
30pc
30pd
30pe
30pf
30pg
30ph
30pi
30pj
30pk
30pl
30pm
30pn
30po
30pp
30pq
30pr
30ps
30pt
30pu
30pv
30pw
30px
30py
30pz
30qa
30qb
30qc
30qd
30qe
30qf
30qg
30qh
30qi
30qj
30qk
30ql
30qm
30qn
30qo
30qp
30qq
30qr
30qs
30qt
30qu
30qv
30qw
30qx
30qy
30qz
30ra
30rb
30rc
30rd
30re
30rf
30rg
30rh
30ri
30rj
30rk
30rl
30rm
30rn
30ro
30rp
30rq
30rr
30rs
30rt
30ru
30rv
30rw
30rx
30ry
30rz
30sa
30sb
30sc
30sd
30se
30sf
30sg
30sh
30si
30sj
30sk
30sl
30sm
30sn
30so
30sp
30sq
30sr
30ss
30st
30su
30sv
30sw
30sx
30sy
30sz
30ta
30tb
30tc
30td
30te
30tf
30tg
30th
30ti
30tj
30tk
30tl
30tm
30tn
30to
30tp
30tq
30tr
30ts
30tt
30tu
30tv
30tw
30tx
30ty
30tz
30ua
30ub
30uc
30ud
30ue
30uf
30ug
30uh
30ui
30uj
30uk
30ul
30um
30un
30uo
30up
30uq
30ur
30us
30ut
30uv
30uw
30ux
30uy
30uz
30va
30vb
30vc
30vd
30ve
30vf
30vg
30vh
30vi
30vj
30vk
30vl
30vm
30vn
30vo
30vp
30vq
30vr
30vs
30vt
30vu
30vv
30vw
30vx
30vy
30vz
30wa
30wb
30wc
30wd
30we
30wf
30wg
30wh
30wi
30wj
30wk
30wl
30wm
30wn
30wo
30wp
30wq
30wr
30ws
30wt
30wu
30wv
30ww
30wx
30wy
30wz
30xa
30xb
30xc
30xd
30xe
30xf
30xg
30xh
30xi
30xj
30xk
30xl
30xm
30xn
30xo
30xp
30xq
30xr
30xs
30xt
30xu
30xv
30xw
30xx
30xy
30xz
30ya
30yb
30yc
30yd
30ye
30yf
30yg
30yh
30yi
30yj
30yk
30yl
30ym
30yn
30yo
30yp
30yq
30yr
30ys
30yt
30yu
30yv
30yw
30yx
30yy
30yz
30za
30zb
30zc
30zd
30ze
30zf
30zg
30zh
30zi
30zj
30zk
30zl
30zm
30zn
30zo
30zp
30zq
30zr
30zs
30zt
30zu
30zv
30zw
30zx
30zy
30zz

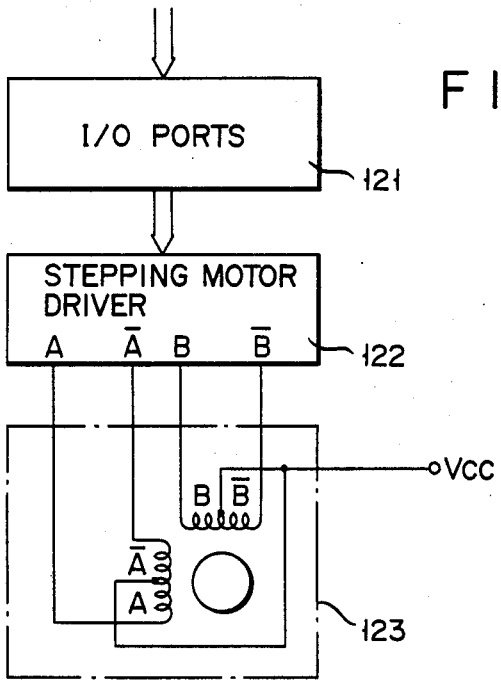
FIG. 11
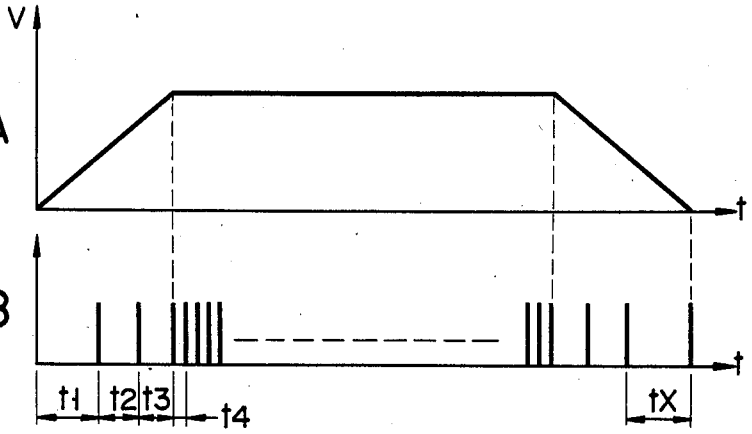
FIG. 12A
FIG. 12B

IMAGE FORMING APPARATUS WITH AREA SELECTION AND CONFIRMATION

BACKGROUND OF THE INVENTION

This invention relates to an image forming apparatus with area selection and confirmation and, more particularly, to an image forming apparatus suitable for an electronic copying machine which can select an image forming area, and confirm the selected area or range.

A conventional electronic copying machine has functions for copying an original image in an equal, enlarged, or reduced size. However, original images often include unnecessary portions (i.e., portions of the originals that are not needed), but no conventional copying machine can selectively form portions of an original image.

For this reason, in the conventional copying machine, if a copying area of an original image can be selected for erasure and the selected erasure area can be confirmed, it results in convenience and efficiency in copying.

SUMMARY OF THE INVENTION

It is, therefore, an object of the present invention to provide a new and improved image forming apparatus with area selection and confirmation, which can specify a portion of an original image to be erased, and can easily confirm a specified erasure area.

For example, according to the present invention, an original image is irradiated with spot light, and the spot light is shifted to specify an erasure area. Light is emitted onto a photosensitive drum in accordance with the specified erasure area, and an electrostatic latent image in the area is erased or selectively discharged to form only the desired image. Thus, the specified erasure area can be indicated by spot light.

These and other objects and features of the present invention can be understood through the following embodiments by reference to the accompanying drawings.

According to one aspect of the present invention, there is provided an image forming apparatus with area selection and confirmation, said apparatus comprising:

an original table on which a light-transmitting original is placed;

transmission light emitting means, provided movably along said original table, for emitting transmisson light through the original placed on said original table;

erasure area specifying means for shifting the light emitted from said transmission light emitting means to an unnecessary portion of the original so as to specify a portion to be erased;

erasure area storage means for storing position data indicating the erasure portion specified by said erasure area specifying means;

checking operation designating means for designating a predetermined checking operation including confirmation of the erasure area specified by said erasure area specifying means;

first control means for reading out the position data stored in said erasure area storage means upon designation of said checking operation designating means and for supplying to said transmission light emitting means a control signal for the predetermined checking operation, including confirmation of the specified erasure area based on the readout position data;

original scanning means, having an optical system moved along said original table, for optically scanning the original placed on said original table;

image forming means for forming and developing an optical image of light reflected from the original by said original scanning means so as to form an image on an image forming medium;

image erasing means for selectively erasing an image to be formed by said image forming means; and second control means for reading out the position data stored in said erasure area storage means during an image forming operation of said image forming means so as to supply the readout data to said image erasing means.

BRIEF DESCRIPTION OF THE DRAWINGS

FIG. 1 to FIG. 24 show an embodiment of an image forming apparatus according to the present invention, in which:

FIGS. 1 and 2 are a schematic perspective view and a side sectional view, respectively, showing the construction of the image forming apparatus;

FIG. 3 is a plan view of a contol panel;

FIG. 4 is a perspective view showing an arrangement of drive sections;

FIG. 5 is a perspective view schematically showing a drive mechanism for an optical system;

FIG. 6 is a perspective view schematically showing a drive mechanism for indexes;

FIG. 7 is a block diagram a general control circuit;

FIG. 8 is a functional block diagram of a main processor group;

FIG. 9 is a functional block diagram of a first sub-processor group;

FIG. 10 is a functional block diagram of a second sub-processor group;

FIG. 11 is a block diagram showing a pulse motor control circuit;

FIGS. 12A and 12B are respectively charts for explaining a method of controlling a speed of a stepping motor;

FIG. 13 is a perspective view of the principal part including a spot light source;

FIG. 14 is a side sectional view of the principal part including the spot light source;

FIGS. 15, 16, and 17 are plan views illustrating an operation for specifying the erasure range of the original using the spot light source;

FIG. 19 is a side sectional view of the principal part showing another arrangement of the erasure array;

FIGS. 20 and 21 are a perspective view and a front view, respectively, of only the principal part of the erasure array, showing the relationship between the erasure array and a photosensitive drum;

FIG. 23 is a circuit diagram illustrating the configuration of an array drive section; and FIG. 24 is a plan view explaining a display operation of an erasure area;

FIGS. 25 and 26 show a second embodiment of an image forming apparatus according to the present invention, in which:

FIG. 26 is a perspective view of the principal part including spot light sources; and FIG. 26 is a side sectional view of the principal part including the spot light sources;

FIGS. 27 and 28 show a third embodiment of an image forming apparatus according to the present invention, in which:

FIG. 27 is a perspective view of the principal; part including spot light sources; and FIG. 28 is a side sectional view of the principal part including the spot light sources;

FIGS. 29 to 33 show a fourth embodiment of an image forming apparatus according to the present invention, in which:

FIGS. 29 and 30 are a schematic perspective view and a side sectional view, respectively, showing the construction,of the image forming apparatus;

FIG. 31 is a plan view of a control panel;

FIG. 32 is a perspective view showing an arrangement of drive section; and

FIG. 33 is a block diagram showing a general control circuit.

DETAILED DESCRIPTION OF THE PREFERRED EMBODIMENTS

Preferred Embodiments of the present invention will be described with reference to the accompanying drawings.

Figure 1:
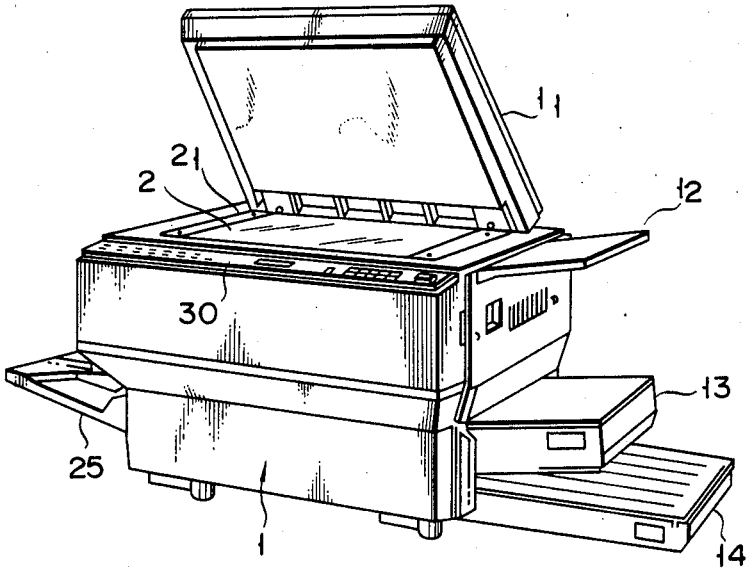
Figure 2:
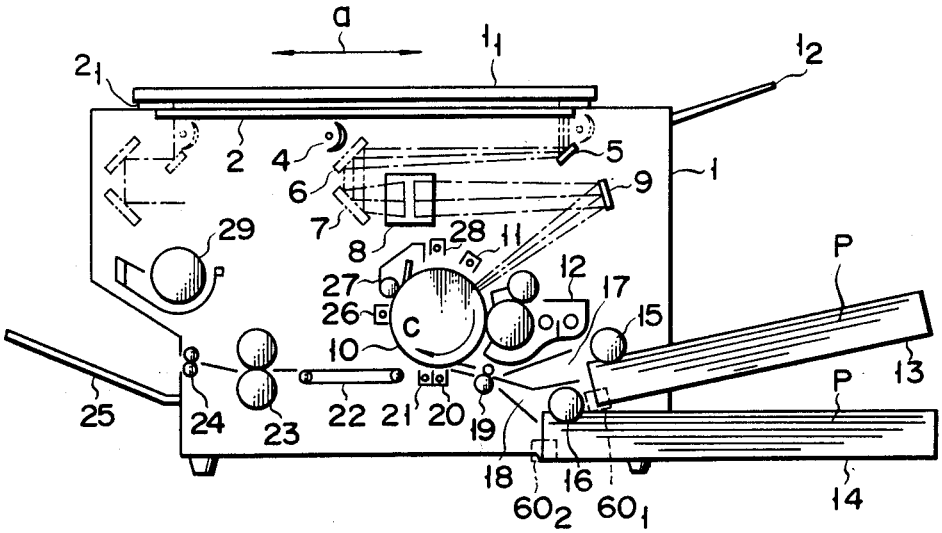

FIGS. 1 and 2 schematically show a copying machine as an image forming apparatus according to a first embodiment of the present invention. Reference numeral 1 denotes a copying machine housing. An original table (i.e., a transparent glass) 2 is fixed on the upper surface of the housing 1. An openable original cover $1_1$ and a work table $1_2$ are arranged near the table 2. A fixed scale $2_1$ as a reference for setting an original is arranged at one end of the table 2 along the longitudinal direction thereof.

The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror 9 to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11. The image of the original is projected on the charged surface of the photosensitive drum 10 by slit exposure, forming an electrostatic latent image on the surface. The electrostatic latent image is developed into a visible image (toner image) by a developing unit 12 using toner. Paper sheets (image record media) P are delivered one by one from an upper paper cassette 13 or a lower paper cassette 14 by a paper-supply roller 15 or 16, and guided along a paper guide path 17 or 18 to an aligning roller pair 19. Then, each paper sheet P is delivered to a transfer region by the aligning roller pair 19, timed to the formation of the visible image.

The two paper cassettes 13 and 14 are removably attached to the lower right end portion of the housing 1, and can be alternatively selected by operation on a control panel which will be described in detail later. The paper cassettes 13 and 14 are provided respectively with cassette size detecting switches 601 and 602 which detect the selected cassette size. The detecting switches 601 and 602 are each formed of a plurality of microswitches which are turned on or off in response to insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image is fixed on the sheet P. After the fixation, the paper sheet P is discharged into a tray 25 outside the housing 1 by an exit roller pair 24.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

FIG. 3 shows a control panel 30 mounted on the housing 1. The control panel 30 carries thereon a copy key $30_1$ for starting the copying operation, ten-keys $30_2$ for setting the number of copies to be made and the like, a display section $30_3$ for indicating the operating conditions of the individual parts or paper jamming, cassette selection keys $30_4$ for alternatively selecting the upper or lower paper cassette 13 or 14, and cassette display sections $30_5$ for indicating the selected cassette. The control panel 30 is further provided with ratio setting keys $30_6$ for setting the enlargement or reduction ratio of copy selected among several predetermined ratios, zoom keys $30_7$ for adjustably setting the enlargement or reduction ratio, a display section $30_8$ for displaying the set ratio, and a density setting section $30_9$ for setting the copy density. Additionally arranged on the control panel 30 are operation keys 30*a*, 30*b*, 30*c* and 30*d* for shifting a spot light source (mentioned later) which serves to indicate as erasure area an unnecessary portion of the original, a position designating key 30*e* for inputting the coordinate positions indicated by the spot light source, and erasure range designating keys 30*f* and 30*g* for designating the erasure ranges in the designated positions.

Reference numeral 30*h* denotes a check key for confirmating a specified erasure area.

Figure 4:
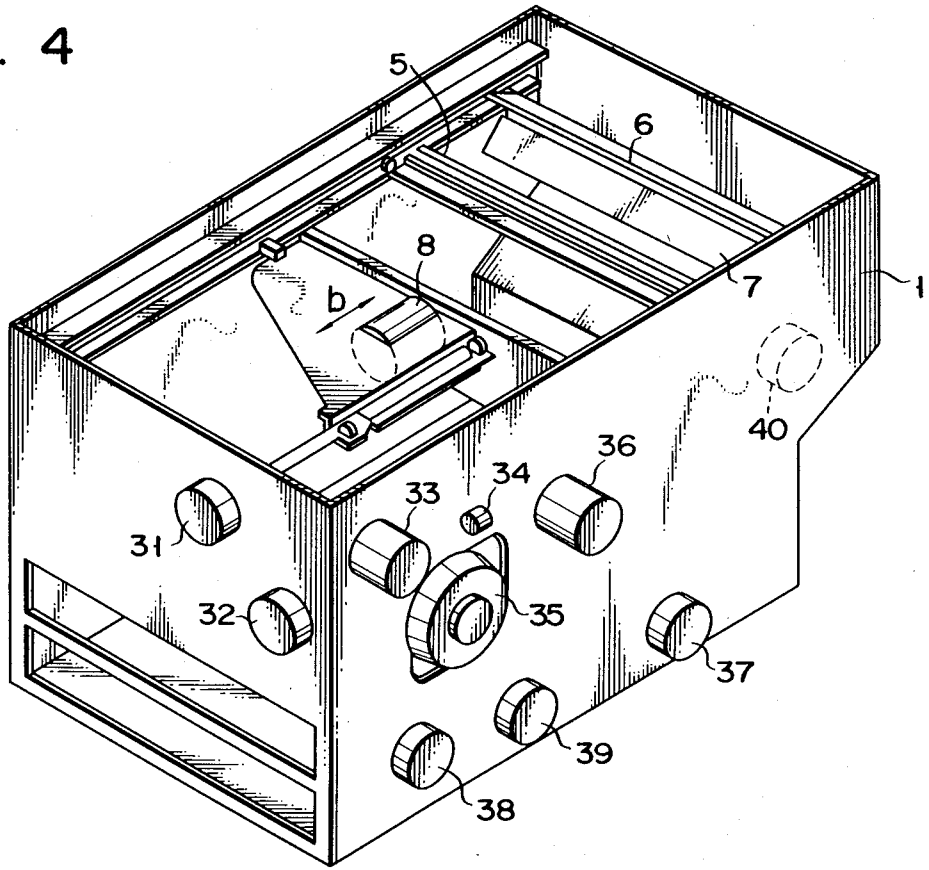

FIG. 4 shows a specific arrangement of drive sources for individual drive sections of the copying machine constructed in the aforesaid manner. The drive sources include the following motors. Numeral 31 designates a motor for lens drive. The lens drive motor 31 serves to shift the position of the lens block 8 for magnification or reduction. Numeral 32 designates a motor for mirror drive. The mirror drive motor 32 serves to change the distance (optical path length) between the mirror 5 and the mirrors 6 and 7 for magnification or reduction. Numeral 33 designates a stepping motor for scanning. The stepping motor 33 serves to move the exposure lamp 4 and the mirrors 5, 6 and 7 for scanning the original. Numeral 34 designates a motor for shutter drive. The shutter drive motor 34 serves to move a shutter (not shown) for adjusting the width of charging of the photosensitive drum 10 by the charger 11 at the time of magnification or reduction.

Numeral 35 designates a motor used for developing. The developing motor 35 serves to drive the developing roller and the like of the developing unit 12. Numeral 36 designates a motor used to drive the drum. The drum drive motor 36 serves to drive the photosensitive drum 10. Numeral 37 designates a motor for fixation. The fixing motor 37 serves to drive the sheet conveyor belt 22, the fixing roller pair 23, and the exit roller pair 24. Numeral 38 designates a motor for paper supply. The paper supply motor 38 serves to drive the paper-supply rollers 15 and 16. Numeral 39 designates a motor for feeding sheets. The sheet feed motor 39 serves to drive the aligning roller pair 19. Numeral 40 designates a motor for fan drive. The fan drive motor 40 serves to drive the cooling fan 29.

Figure 5:
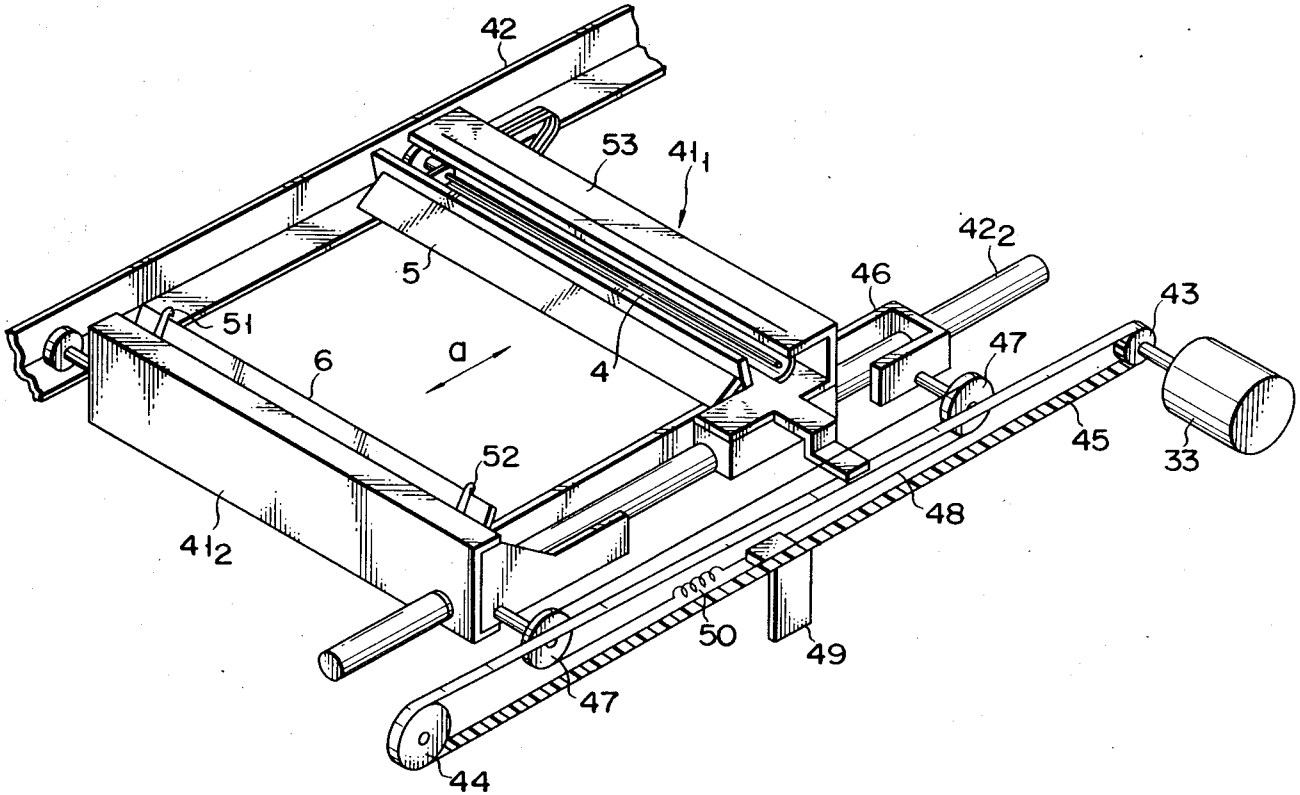

FIG. 5 shows a drive mechanism for reciprocating the optical system 3. The mirror 5 and the exposure lamp 4 are supported by a first carriage $41_1$, and the mirrors 6 and 7 by a second carriage $41_2$. These carriages $41_1$ and $41_2$ can move parallel in the direction indicated by arrow a, guided by guide rails $42_1$ and $42_2$.

The four-phase motor 33 drives a pulley 43. An endless belt 45 is stretched between the pulley 43 and an idle pulley 44, and one end of the first carriage 411 supporting the mirror 5 is fixed to the middle portion of the belt 45.

On the other hand, two pulleys 47 are rotatably attached to a guide portion 46 (for the rail 422) of the second carriage 412 supporting the mirrors 6 and 7, spaced in the axial direction of the rail $42_2$. A wire 48 is stretched between the two pulleys 47. One end of the wire 48 is connected directly to a fixed portion 49, while the other end is connected thereto by means of a coil spring 50. The one end of the first carriage 411 is fixed to the middle portion of the wire 48.

With this arrangement, when the stepping motor 33 is driven, the belt 45 turns around to move the first carriage $41_1$. As the first carriage $41_1$ travels, the second carriage $41_2$ also travelss. Since the pulleys 47 then serve as movable pulleys, the second carriage $41_2$ travels in the same direction as and at a speed half that of the first carriage $41_1$. The traveling direction of the first and second carriages $41_1$ and $41_2$ is controlled by changing the rotating direction of the stepping motor 33.

The original table 2 carries thereon an indication of a reproducible range corresponding to the size of designated paper sheets. If the sheet size designated by the sheet selection keys $30_4$ and the copy ratio specified by the ratio setting keys $30_6$ or $30_7$ are (Px, Py) and K, respectively, the reproducible range (x, y) is given by $x = Px/K,$ $y = Py/K.$ Out of the coordinates (x, y) designating any point within the reproducible range, as shown in FIG. 1, the x coordinate is indicated by indexes 51 and 52 arranged on the inside of the original table 2, and the y coordinate by a scale 53 provided on the top face portion of the first carriage $41_1$.

Figure 6:
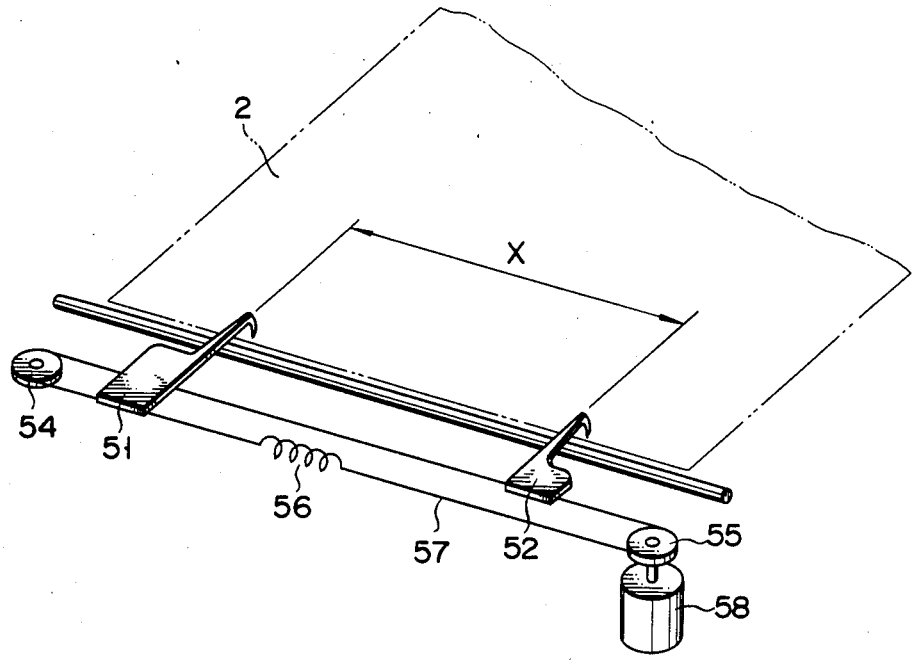

As shown in FIG. 6, the indexes 51 and 52 are attached to a wire 57 which is stretched between pulleys 54 and 55 through the aid of a spring 56. The pulley 55 is rotated by a motor 58. The distance between the indexes 51 and 52 can be changed by driving the motor 58 in accordance with the sheet size and the enlargement or reduction ratio.

The first carriage $41_1$ moves to a predetermined position (home position depending on the enlargement or reduction ratio) as the motor 33 is driven in accordance with the sheet size and the ratio. When the copy key $30_1$ is depressed, the first carriage $41_1$ is first moved toward the second carriage $41_2$. The, lamp 4 is lighted and the first carriage $41_1$ is moved away from the second carriage $41_2$. When the original scanning ends, the lamp 4 is turned off, and the first carriage $41_1$ is returned to the home position.

Figure 7:
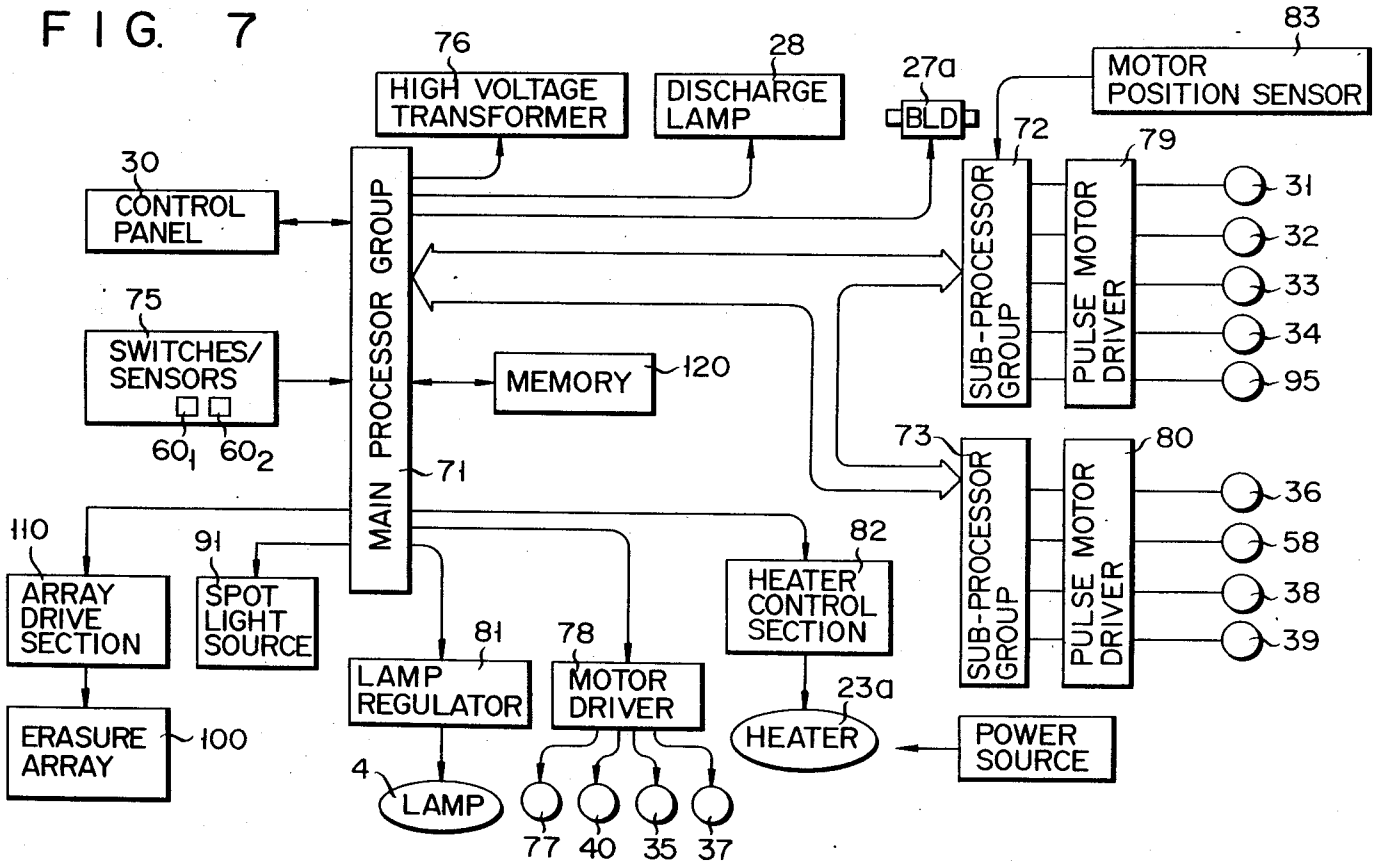

FIG. 7 shows a general control circuit of the electronic copying machine. This control circuit is mainly composed of a main processor group 71 and first and second sub-processor groups 72 and 73. The main processor group 71 detects input data from the control panel 30 and a group of input devices 75 including various switches and sensors, such as the cassette size detection switches 601 and 602 and controls a high-voltage transformer 76 for driving the chargers, the discharge lamp 28, a blade solenoid **27*a* of the cleaner 27, a heater 23*a* of the fixing roller pair 23, the exposure lamp 4, and the motors 31 to 40 and 58, thus accomplishing the copying operation. The main processor group 71 also controls a spot light source 131, a pulse motor 135, an erasure array 150, an array drive section 160, and a memory 160, thereby erasing any unnecessary portions of the original. These components 131, 135, 150, 160 and 140** will be described in detail later.

The motors 35, 37 and 40 and a toner-supply motor 77 for supplying the toner to the developing unit 12 are connected through a motor driver 78 to the main processor group 71 to be controlled thereby. The motors 31 to 34 and 95 are connected through a stepping motor driver 79 to the first subprocessor group 72 to be controlled thereby. The motors 36, 38, 39 and 58 are connected through a stepping motor driver 80 to the second sub-processor group 73 to be controlled thereby.

Further, the exposure lamp 4 is controlled by the main processor group 71 through a lamp regulator 81, and the heater **23*a* by the main processor group 71 through a heater control section 82. The main processor group 71 gives instructions for the start or stop of the individual motors to the first and second sub-processor groups 72 and 73. Thereupon, the first and second sub-processor groups 72 and 73 feed the main processor group 17 with status signals indicative of the operation mode of the motors. Also, the first sub-processor group 72 is supplied with positional information from a position sensor 83 for detecting the respective initial positions of the motors 31 to 34**.

Figure 8:
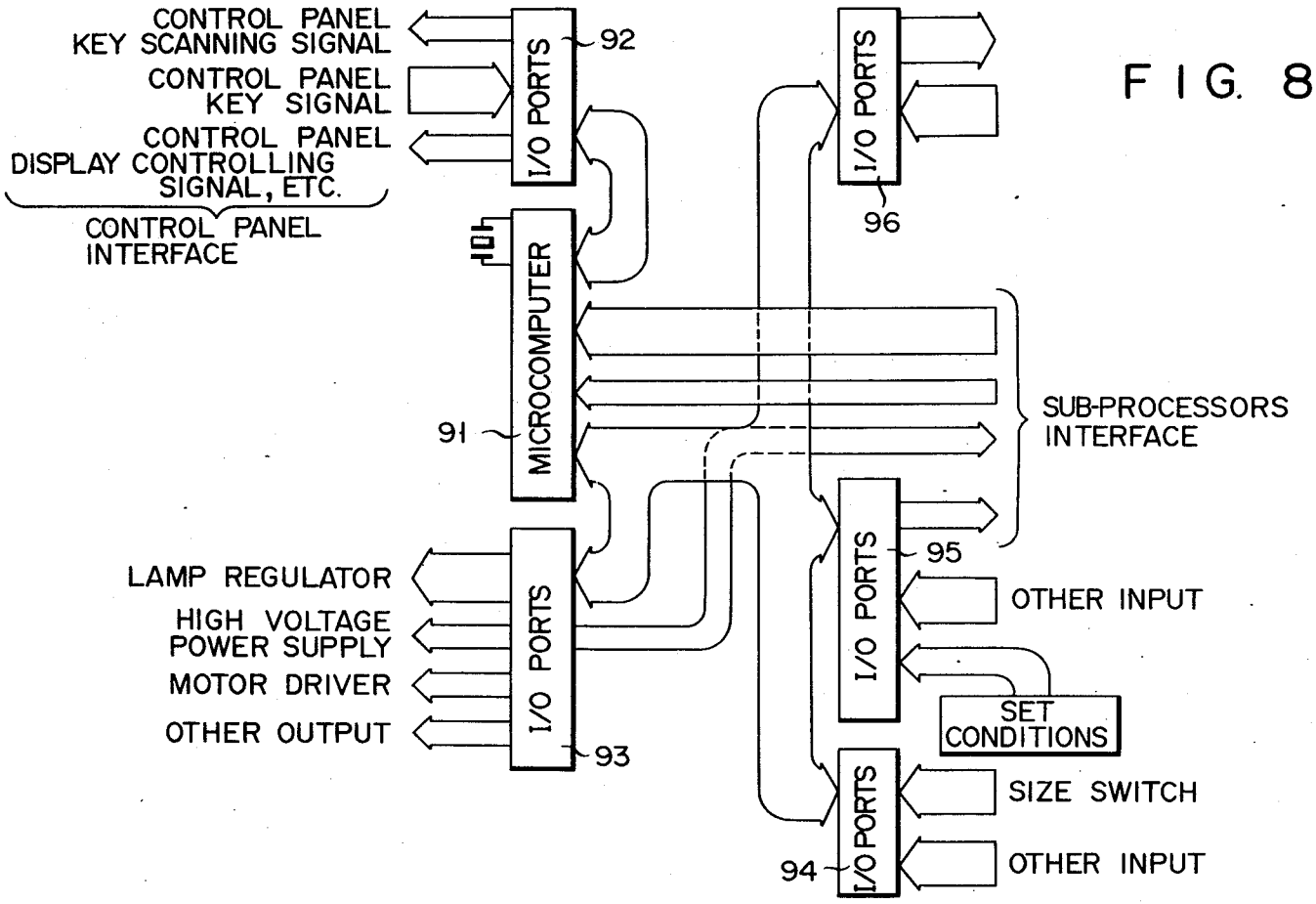

FIG. 8 shows an arrangement of the main processor group 71. Reference numeral 91 denotes a one-chip microcomputer (to be referred to as a CPU hereinafter). The CPU 91 detects key inputs at a control panel (not shown) through an I/0 port 92 and controls display operations. The CPU 91 can be expanded through I/O ports 93 to 96. The port 93 is connected to a high-voltage transformer 76, a motor driver 78, a lamp regulator 81 and other outputs. The port 94 is connected to a size switch for detecting a paper size and other inputs. The port 95 is connected to a copying condition setting switch and other inputs. The port 96 is optional.

Figure 9:
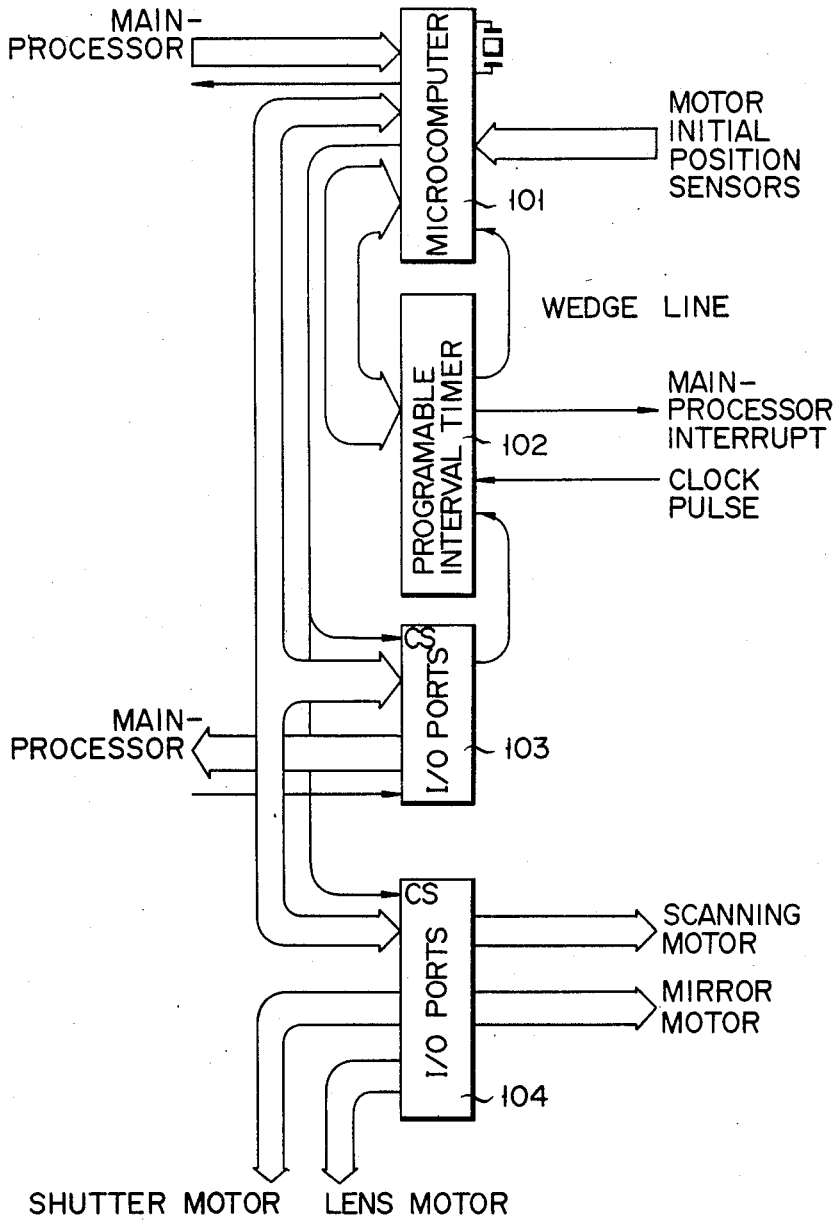

FIG. 9 shows an arrangement of the first sub-processor group 72. Reference numeral 101 denotes a CPU connected to the group 71. Reference numeral 102 denotes a programable interval timer for controlling switching time intervals. A preset value from the CPU 101 is set in the programable interval timer, and the timer is started. When the timer is stopped, the timer sends an end pulse onto an interrupt line of the CPU 101. The timer 102 receives a reference clock pulse. The CPU 101 receives position data from a position sensor 83 and is connected to I/O ports 103 and 104. The port 104 is connected to motors 31 to 34 and 135 through the stepping motor driver 79. The port 103 is used to supply a status signal from each pulse motor to the group 71.

Figure 10:
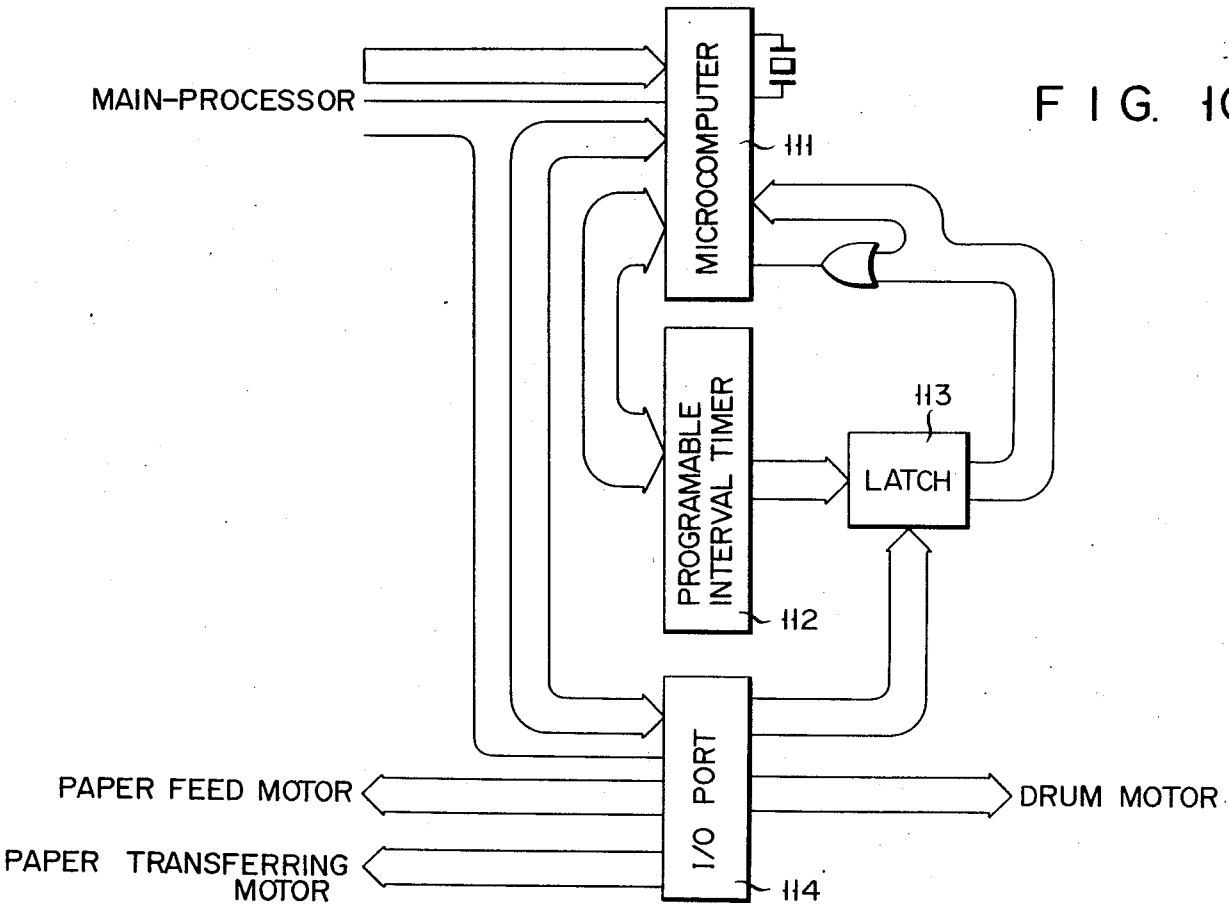

FIG. 10 shows an arrangement of the second sub-processor group 73. Reference numeral 111 denotes a CPU connected to the group 71. Reference numeral 112 denotes a programable interval timer for controlling switching time intervals of the pulse motors. A preset value from the CPU 111 is set in the programable interval timer, and the timer is started. When the timer is stopped, it generates an end pulse. The end pulse is latched by a latch 113, and an output therefrom is supplied onto the interrupt line of the CPU 111 and the input line of the I/O port. The CPU 111 is connected to an I/O port 114 which is then connected to motors 36, 38, 39 and 58 through the driver 80. FIG. 11 shows a pulse motor control circuit. An I/0 port 121 (corresponding to the ports 104 and 114 of FIGS. 8 and 9) is connected to a stepping motor driver 2 (corresponding to the drivers 79 and 80 of FIG. 6). The driver 122 is connected to windings A, $\overline{A}$, B and $\overline{B}$ of a stepping motor 123 (corresponding to the motors 31 to 4, 36, 38 and 39).

FIGS. 12A and 12B show a method of controlling a stepping motor speed. FIG. 12A shows a stepping motor speed curve, and FIG. 12B shows switching intervals. As is apparent from FIGS. 12A and 12B, the switching intervals are long at the beginning, are gradually decreased, and finally stop to decrease. Then, the intervals are prolonged, and the stepping motor is finally stopped. This cycle indicates the through-up and through-down of the pulse motor. The motor is started from the self starting region, operated in a high-speed region and is gradually stopped. Reference symbols $t_1$, $t_2$, . . . $t_x$ denote times between the switching intervals.

Indicating means and erasing means according to the present invention will now be described in detail.

Figure 13:
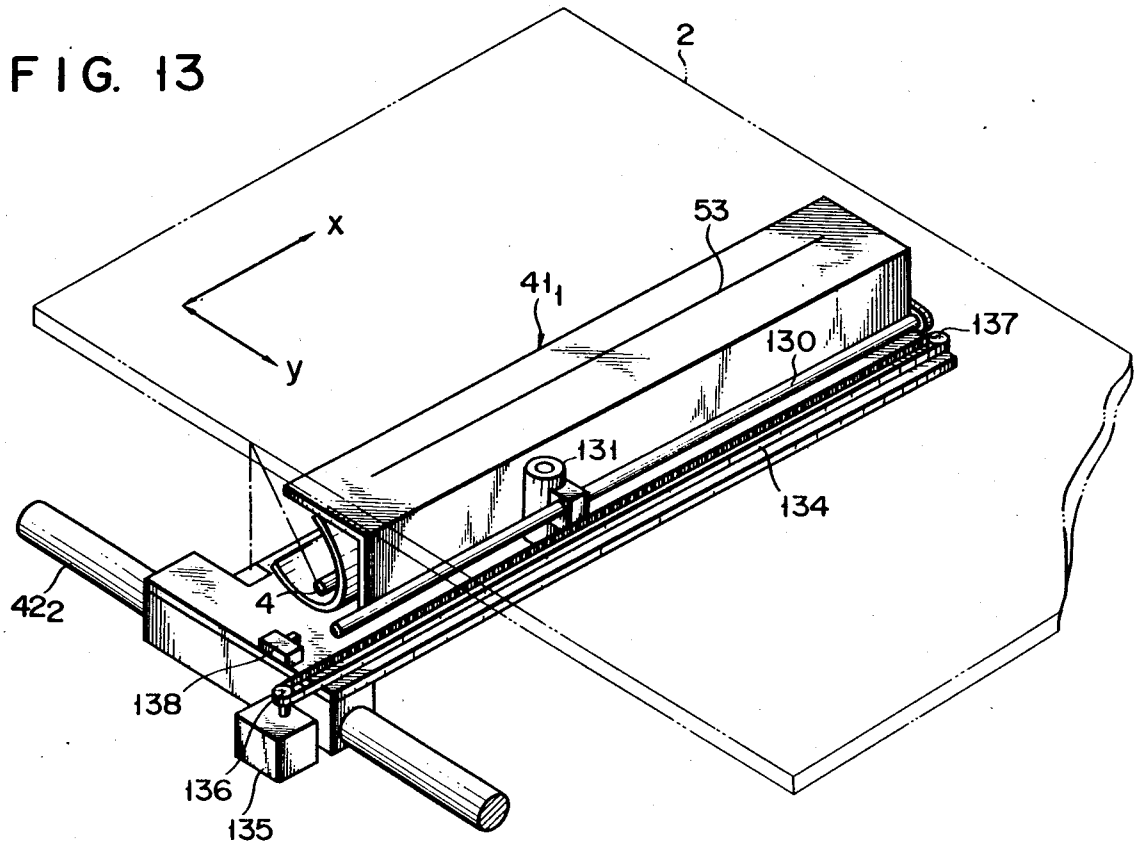
Figure 14:
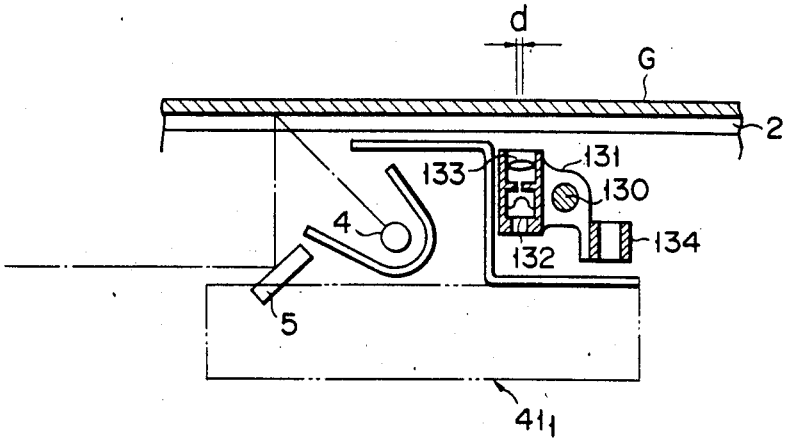

In FIGS. 13 and 14, a guide shaft 130 is disposed at that portion of the first carriage $41_1$ intercepting the light from the lamp 4, extending along the lamp 4. The guide shaft 130 is movably fitted with the spot light source 131 as the indicating means for indicating an erasure range of the original. As shown in FIG. 14, the spot light source 131 includes a light emitting element 132, such as a light emitting diode or lamp, and a lens 133 which are opposed to the original table 2.

A light beam emitted from the light emitting element 132 is applied to the original table 2 through the lens 133, as a spot light with a diameter d of, e.g., 2 mm. The spot light has enough brightness to be transmitted through an original G as thick as, e.g., a postcard set on the original table 2. The spot light source 131 is coupled to a timing belt (toothed belt) 134 extending along the guide shaft 130. The timing belt 134 is stretched between a pulley 136 mounted on the shaft of the stepping motor 135 and a driven pulley 137. As the stepping motor 135 is rotated the spot light source 131 is moved in a direction perpendicular to the scanning direction of the first carriage $41_1$.

A position sensor 138 formed of a microswitch for detecting the initial position of the spot light source 131 is attached to that portion of the first carriage $41_1$ which is located beside the end portion of the guide shaft 130 on the side of the stepping motor 135. When the spot light source 131 is moved, for example, it first abuts against the position sensor 134 to have its initial position detected thereby.

Figure 15:
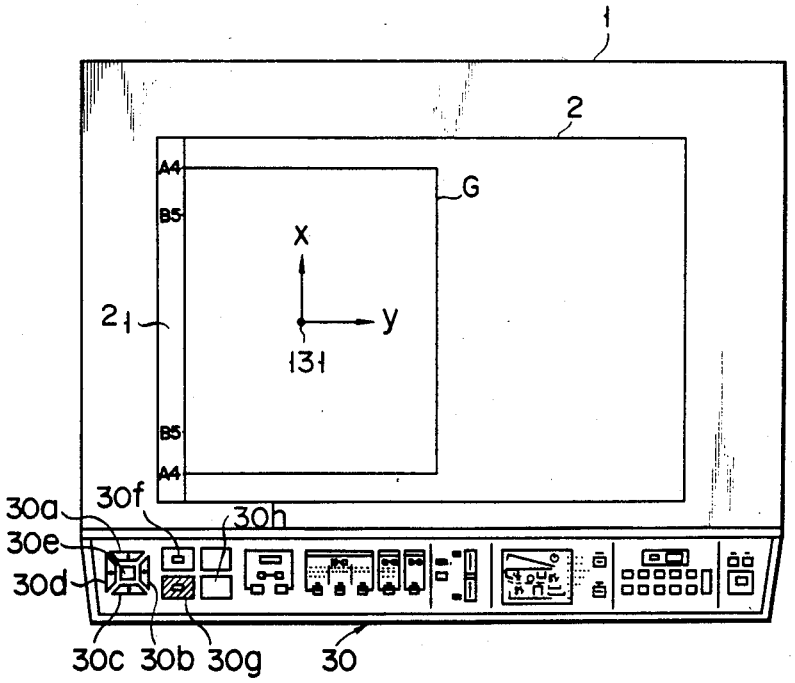
Figure 16:
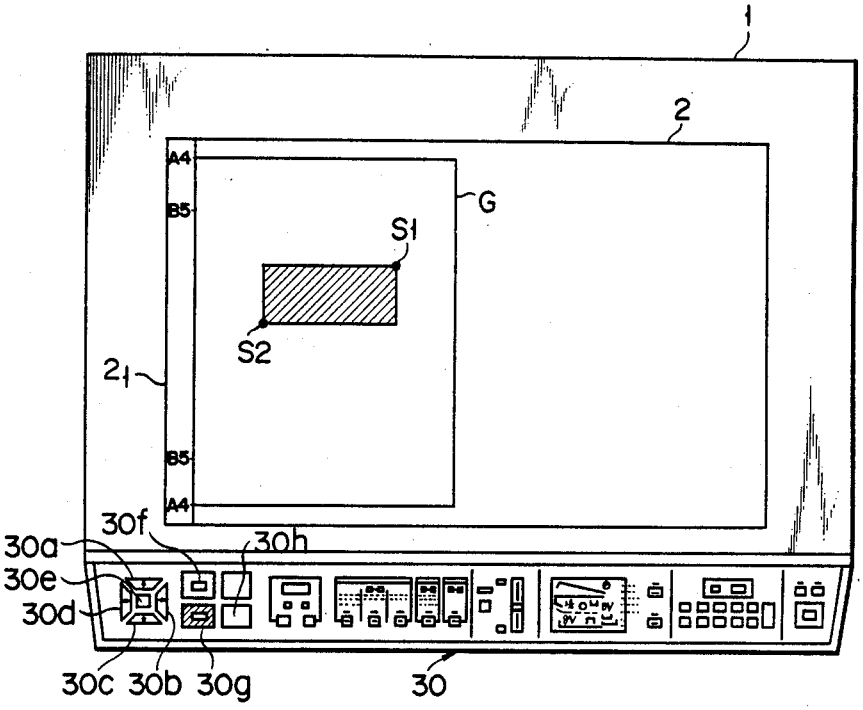
Figure 17:
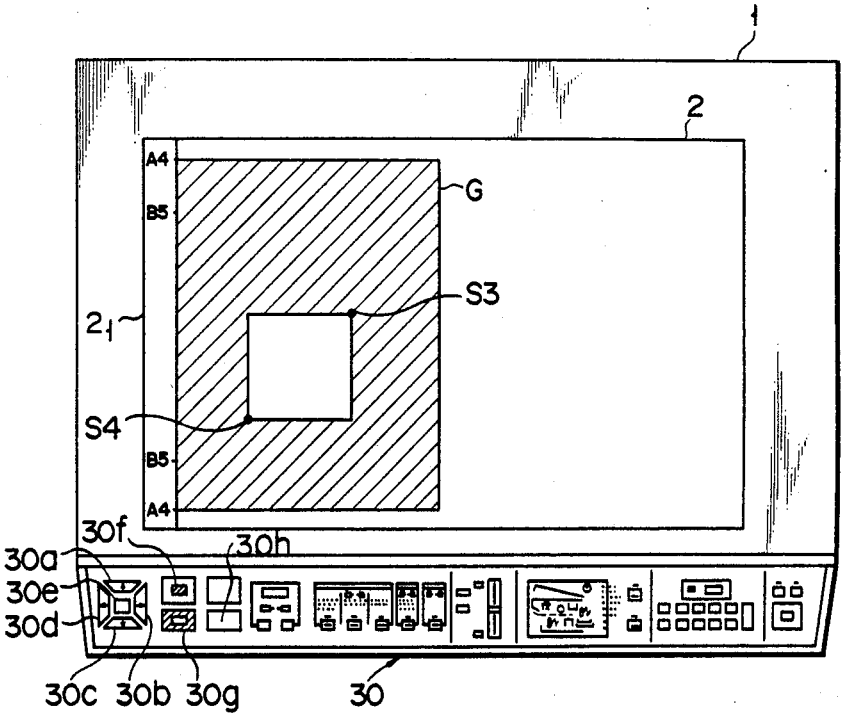

Referring now to FIGS. 15 to 17, there will be described a method for designating the erasure range of the original by means of the spot light source 131.

The spot light source 131 is moved by operating the operation keys 30*a* to 30*d*. When the operation keys 30*b* and 30*d* are depressed, the motor 33 is started, and the first carriage $41_1$ and the spot light source 131 are moved in the scanning direction (indicated by arrow y in FIG. 15). When the operation keys 30*a* and 30*c* are depressed, on the other hand, the motor 135 is started, and the spot light source 131 is moved in a direction (indicated by arrow x in FIG. 15) perpendicular to the scanning direction.

Observing the spot light transmitted through the original G, the operator operates the operation keys 30*a* to 30*d*. When the spot light reaches, for example, a spot S1 on the original G shown in FIG. 16, the operator depresses the position designating key 30*e*. Thereupon, the coordinate position (x1,y1) indicated by the spot S1 is stored in the main processor group 71 shown in FIG. 7. Likewise, if the position designating key 30*e* is depressed when a spot S2 on the original G is reached by the spot light, the position (x2,y2) of the spot S2 is stored in the main processor group 71. This position of the spot light can be detected by, for example, counting drive pulses delivered from the stepping motors 33 and 135. When the erasure range designating key 30*f* is depressed thereafter, a rectangular region (hatched region) having its two opposite vertexes on the spots S1 and S2 is designated as the erasure range, as shown in FIG. 16.

If the erasure range designating key 30g is depressed after designating spots S3 and S4 on the original G, the other region of the original G (i.e. not a square region having its two opposite vertexes on the spots S3 and S4) is designated as the erasure range, as shown in FIG. 17.

Figure 18A:
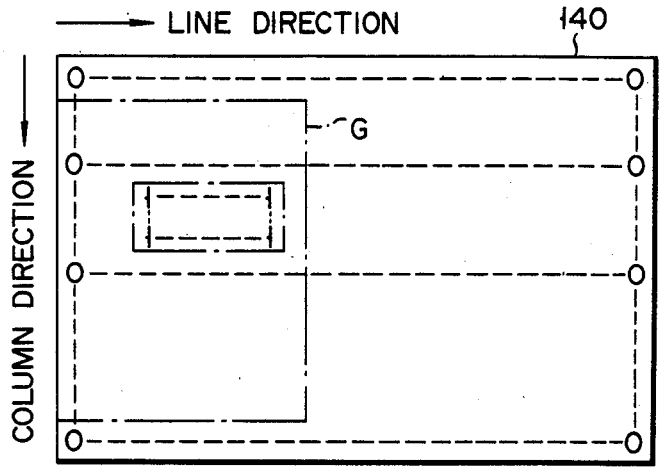
FIGS. 18A and 18B are respectively views for explaining the contents of a memory.
Figure 18B:
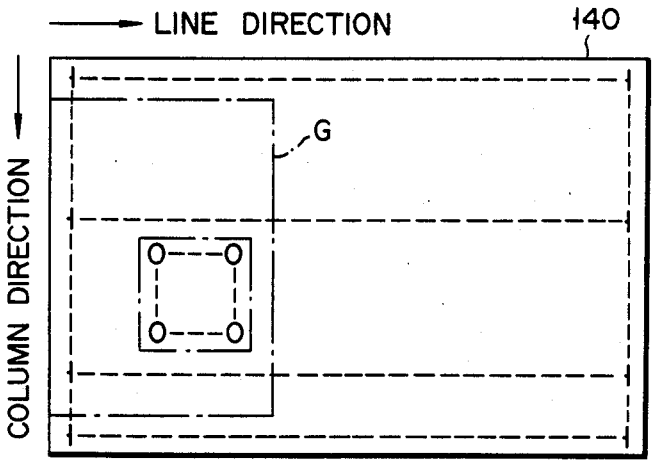

Thus, if the key 30*f* or 30*g* is depressed, the group 71 performs arithmetic operation in accordance with the specified two positions. Position data of the erasure area are set at logic "1" and position data of an area excluding the erasure area are set at logic "0". These position data are stored in the memory 140. A rank capacity of the memory 140 substantially corresponds to a value given by (moving distance of the source 131 along the x direction)÷(position resolution along the x direction). A line capacity of the memory 140 substantially corresponds to a value given by (moving distance of the source 131 along the y direction)÷(position resolution thereof along the y direction). The memory 140 comprises a RAM having the memory capacity described above. In the cases of FIGS. 16 and 17, high level signals are stored at addresses corresponding to the hatched area and low level signals are stored at other addresses in response to the data supplied from the group 71, as shown in FIGS. 18A and 18B, respectively.

Figure 19A:
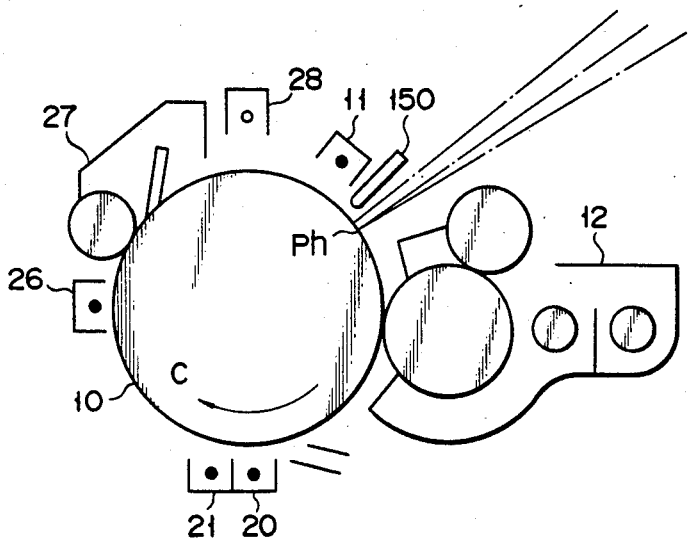
FIG. 19A is a side section view of the principal part showing an arrangement of the erasure array.
Figure 20:
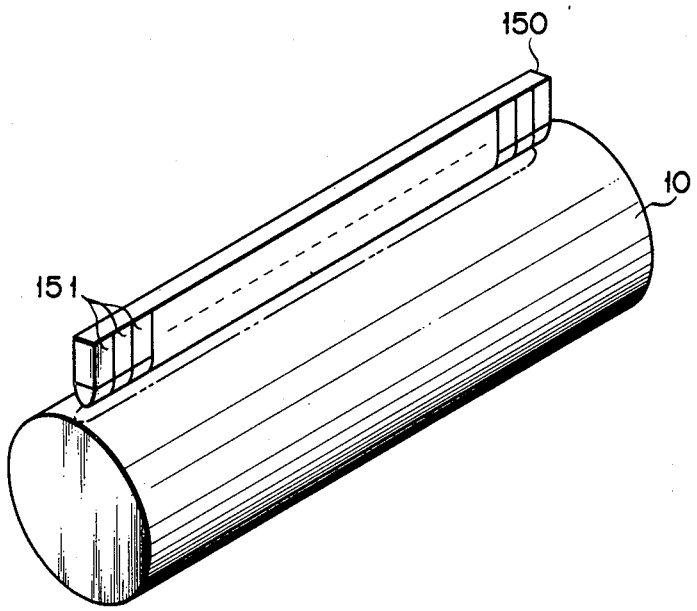
Figure 21:
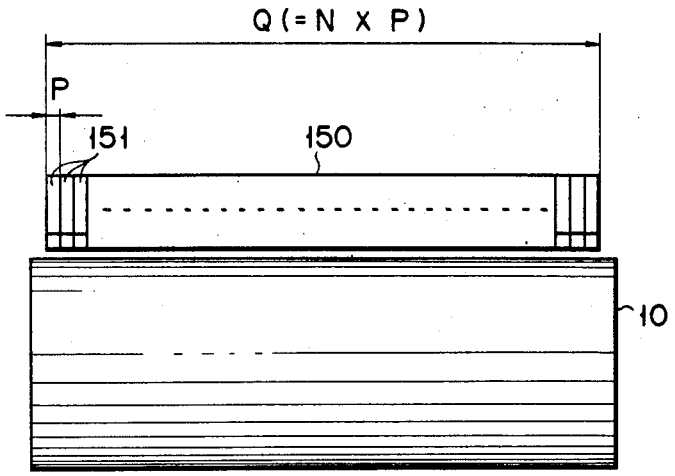
Figure 22A:
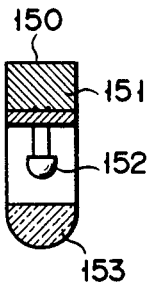
FIG. 22A is a side sectional view of the erasure array.
Figure 22B:
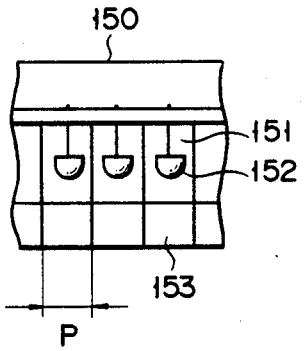
FIG. 22B is a partial front view of the erasure aray.

As shown in FIG. 19A, on the other hand, the erasure array 150 as the erasing means is disposed close to the photosensitive drum 10, between the charger 11 and an exposure region Ph, for example. As shown in FIGS. 20 and 21, the erasure array 150 includes a plurality of shading cells 151 which are arranged in a direction perpendicular to the rotating direction of the photosensitive drum 10. As shown in FIGS. 22A and 22B, the cells 151 each contains therein a light emitting element 152 formed of, e.g., a light emitting diode. Moreover, a lens 153 for converging light from the light emitting element 152 on the surface of the photosensitive drum 10 is disposed at the opening portion of each cell 151 facing the photosensitive drum 10.

The number of light-emitting elements arranged in erasure array 150 corresponds to the same as the column capacity of memory 140. When the distance between light-emitting elements 152 is given by P and the number of elements is given by N, overall length Q of array 150 is given by Q=N·P.

Figure 23:
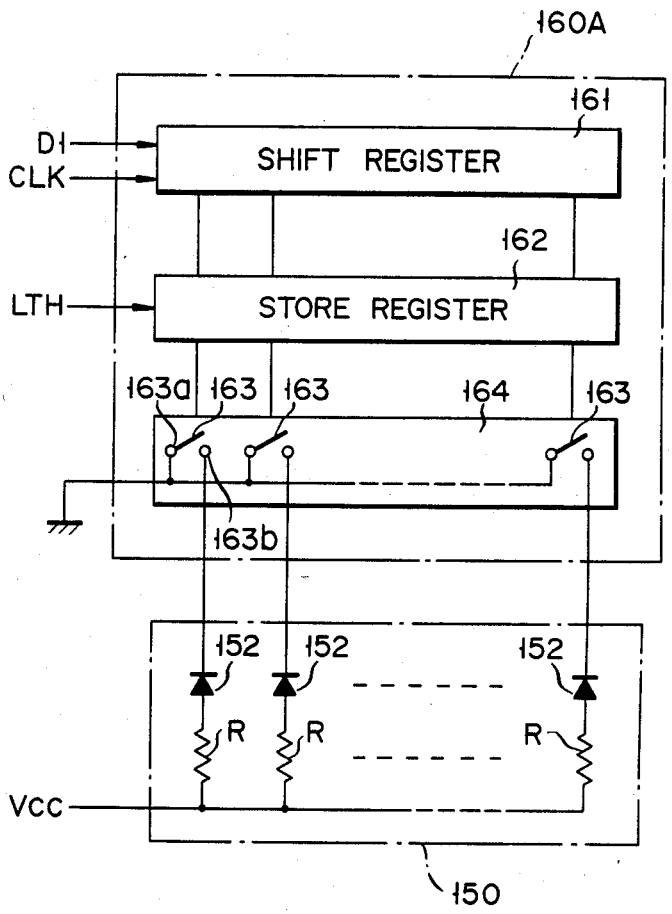

The array 150 is driven by an array drive section 160. As shown in FIG. 23, the section 160 comprises a shift register 161 having the same bit number as the rank bit number of the memory 140, a store register 162 for storing the content of the register 161, and a switching circuit 164 consisting of a plurality of switch elements 163 which are turned on/off in response to output signals from the register 162. Movable contacts 163*a* of the elements 163 are grounded, and stationary contacts 163*b* thereof are respectively connected to the cathodes of the elements (diodes) 152 constituting the array 150. The anodes of the elements 152 are connected to a power source VCC through the corresponding current limiting resistors R.

After, as the erasure area the unnecessary portion of the original is specified, he closes the original cover $1_1$ and depresses the key $30_1$. The carriage $41_1$ and drum 10 are driven, and one-rank data are sequentially read out along the line direction (FIGS. 20 and 21) of the memory 140. The readout data D1 are transferred to the register 161 in the section 160 in response to the clock signal CLK. After one-rank data is transferred to the register 161 and the charged portion of the drum 10 reaches the array 150, the group 71 generates a latch signal LTH. The storage data is supplied from the register 161 to the register 162 in response to the latch signal LTH. Since the array 150 is arranged between the charger 11 and the exposure portion Ph, the output timing of the latch signal LTH is controlled such that the one-rank data is transferred from the memory 140 to the register 162 prior to $\theta 1/\omega$ where $\theta 1$ is the angle between the array 150 and the portion Ph and $\omega$ is the peripheral velocity of the drum 10.

The elements 163 in the circuit 164 are controlled in response to the output signal from the register 162. When the output of the register 162 is set at high level, the elements 163 are turned on. When the output of the register 162 is set at low level, the elements 163 are turned off. The elements 152 connected to the elements 163 are turned on when the elements 163 are turned on. Otherwise, the elements 152 are turned off. A charged drum portion corresponding to the ON elements 152 is discharged, and the remaining portion is not discharged, so that a latent image is not formed in the discharged portion even if the surface of the drum 10 is exposed with light. In this manner, the unnecessary portion for one rank if erased. The data is thus read out from the memory 140 in units of ranks, thereby erasing the unnecessary image portion.

The operation when check key 30*h* is depressed will now be described.

After keys 30*a* to 30*d* and position designating key 30*e* are operated, when check key 30*h* is operated, a specified erasure area is indicated and main processor group 71 drives first carriage $41_1$ and spot light source 131 in accordance with the stored coordinates of spot light.

Figure 24:
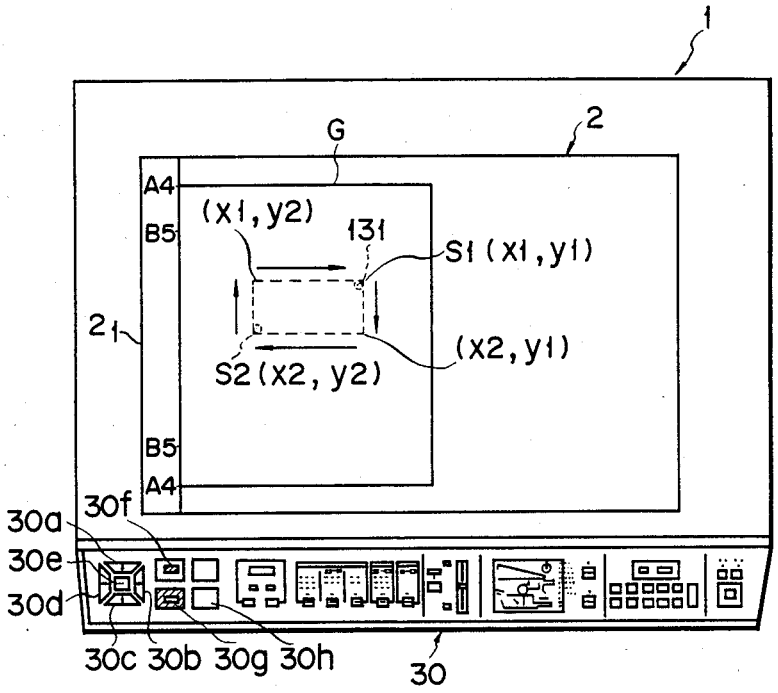

Assume that a specified erasure area is defined by coordinates S1(x1,y1) and S2(x2,y2), as shown in FIG. 24. On operation of check key 30*n*, spot light source 131 is shifted to stored coordinate position S1(x1,y1). In doing this, an illumination signal is supplied to light emitting element 132 from main processor group 71, so as to turn it on. First carriage $41_1$ and spot light source 131 are then driven, and the spot light is shifted in the directions indicated by arrows in FIG. 24. More specifically, carriage $41_1$ is driven so that spot light source 131 is shifted from coordinate position S1(x1,y1) to (x2,y1) and then from position (x2,y1) to S2(x2,y2). Thereafter, carriage $41_1$ is driven so that the spot light is shifted to position (x1,y2) and finally, from position (x1,y2) to starting position S1(x1,y1). In this way, the erasure area is indicated. When light source 131 again reaches position S1, light emitting element 132 is turned off.

When a plurality of erasure areas are specified, after a certain erasure area has been indicated, light source 131 is shifted to the coordinate position of the next specified erasure area, and this is indicated in the same manner as above.

Thus, according to this embodiment, since an unnecessary portion of an original image is specified and erased, it is easy to edit original images.

A specified erasure area is indicated using light source 131 when check key 30*h* is operated simply, thus allowing the erasure area to be easily checked.

Furthermore, since light source 131 is mounted on carriage $41_1$, the interior of the copying machine can be used efficiently, preventing an increase in size of the machine.

Figure 25:
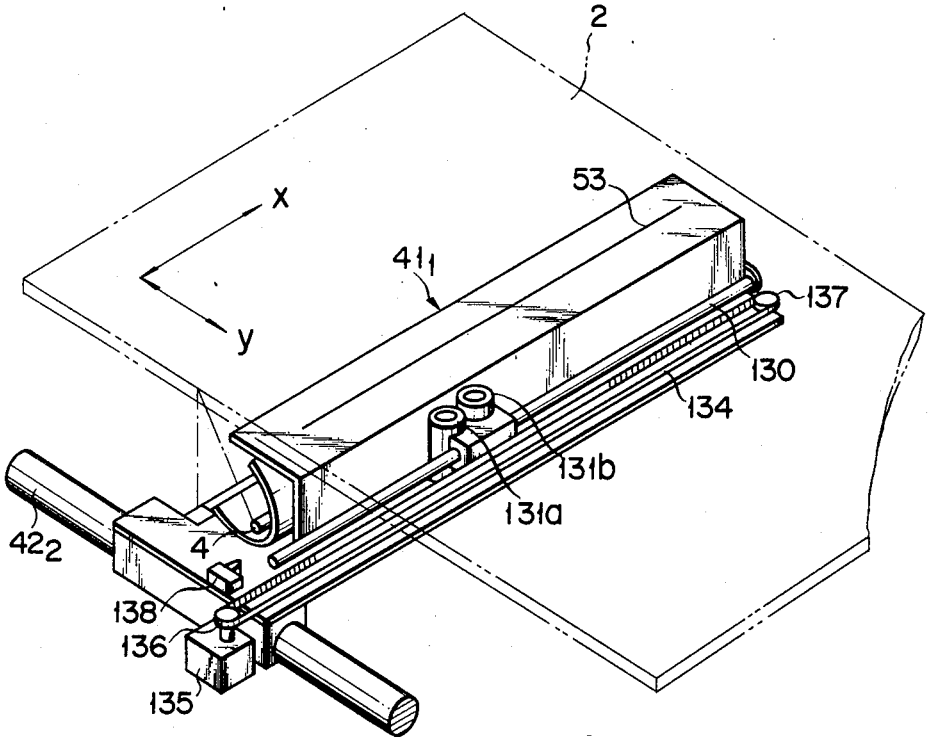
Figure 26:
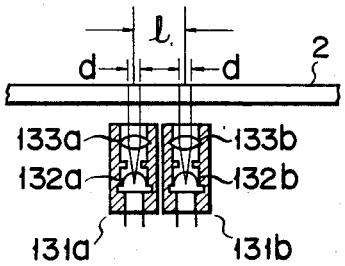

A second embodiment of the present invention will now be described. An apparatus of the second embodiment has substantially the same arrangement as that of the first embodiment, except that two spot light sources 131*a* and 131*b* are provided in place of single spot light source 131, as shown in FIGS. 25 and 26. In this embodiment, therefore, related drawings used in the first embodiment and descriptions thereof are omitted, and an arrangement for the light source different from the first embodiment will be described.

Spot light sources 131*a* and 131*b* each comprise light emitting elements 132*a* and 132*b* (e.g., a light emitting diode or a lamp) and lenses 133*a* and 133*b*, respectively. Light beams emitted from light emitting elements 132*a* and 132*b* are focused as spot beams of diameter d on original table 2, through lenses 133*a* and 133*b*. These spot beams are separated at distance l, and provide illuminance which enables light to be transmitted through an original image up to the thickness of a post card. Elements 132*a* and 132*b* emit light beams of different colors. For example, element 132*a* emits a red light beam, and element 132*b* emits a green light beam.

When an unnecessary portion of an original image is specified as an erasure area, one (132*a*) of elements 132*a* and 132*b* is illuminated, and an operator operates keys 30*a* to 30*d* while visually observing the red spot beam transmitted through original G.

When a copying magnification is set by magnification setting key $30_6$ and zoom key $30_7$, the magnification is multiplied with the preset coordinate position, thus shifting the coordinate position corresponding to the enlargement or reduction mode. Based on the shifted coordinate position, a HIGH level signal is stored in an erasure area portion of memory 140, and a LOW level signal is stored in a remaining portion of memory 140.

After an unnecessary portion of original G is specified as an erasure area, original G is set on original table 2 with its copying surface upward. When the copying operation is performed, original G is turned over along stationary scale $2_1$. In practice, therefore, positions of signals stored in memory 140 are inverted in the column direction.

An erasure area is indicated in such a manner that main processor group 71 selectively drives first carriage $41_1$ and spot light sources 131*a* and 131*b* in accordance with the erasure area and coordinate positions for spot beams stored in memory 140.

For example, when an erasure area is inside an area specified by coorinates S1(x1,y1) and S2(x2,y2), as shown in FIG. 24, the erasure area is indicated using red spot light source 131*a*.

More specifically, when red spot light source 131*a* is illuminated and shifted, it identifies that the erasure area is the indicated area surrounded by arrows in FIG. 24.

On the other hand, when the erasure area is outside the area specified by coordinates S1(x1,y1) and S2(x2,y2) of FIG. 24, it is indicated by using green spot light source 131*b*. In this case, since light source 131*b* is separated from light source 131a specifying the erasure area at distance l in the x direction, x coordinates of positions S1 and S2 are corrected in accordance with distance l. More specifically, light source 131*b* is first shifted to a position corresponding to S1(x1,y1) with corrected coordinates. In this state, an illumination signal is generated from main processor group 71, turning on element 132*b*. Thereafter, light source 131*b* is shifted in the direction indicated by arrows in FIG. 24, thus indicating the erasure area with the green spot beam. In this manner, when light source 131*b* is illuminated and shifted, it identifies that the erasure area is outside the indicated area of FIG. 24.

Thus, according to the second embodiment, spot light sources 131*a* and 131*b* emitting light beams of different colors are mounted on first carriage $41_1$, an erasure area is specified by light source 131*a*, and a portion of the original image corresponding to the specified area is erased during an image forming operation. Therefore, an unnecessary portion of an original can be selectively erased, resulting in convenience and efficiency in copying.

The specified erasure area is indicated on an original by illuminating and shifting spot light source 131*a* or 131*b*. Furthermore, it can be determined by the use of different color spot beams whether the erasure area is inside or outside the original indicated area. Thereby, the erasure area can be easily confirmed.

A third embodiment of the present invention will now be described. The same reference numerals in this embodiment denote the same parts as in the second embodiment, and a light source arrangement different therefrom will be described.

Figure 27:
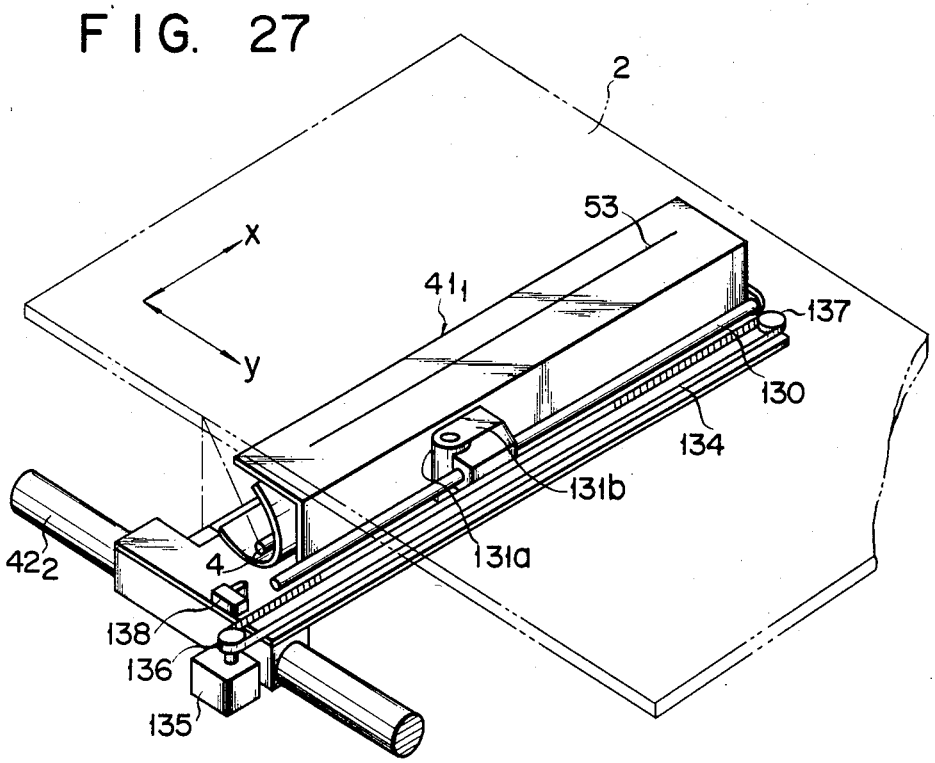
Figure 28:
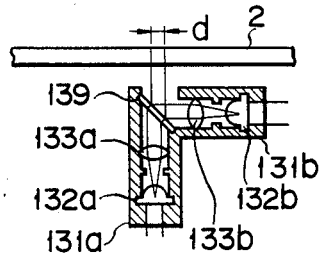

Referring to FIGS. 27 and 28, spot light sources 131*a* and 131*b* are provided so that their optical axes are perpendicular to each other. That is, light source 131*a* is arranged so that its optical axis is perpendicular to original table 2, and light source 131*b* is arranged so that its optical axis is perpendicular to that of light souce 131*a*. Half mirror 139 is provided at the intersection of the optical axes of light sources 131*a* and 131*b*. Therefore, light beams emitted from light sources 131*a* and 131*b* are focused at an identical position on original table 2 by mirror 139.

The above arrangement of the third embodiment can provide the same effects as those of the second embodiment. In addition, since light beams emitted from light sources 131*a* and 131*b* are focused at an identical position on original table 2, a radiating position of a spot beam need not be corrected when an erasure area is indicated.

Figure 29:
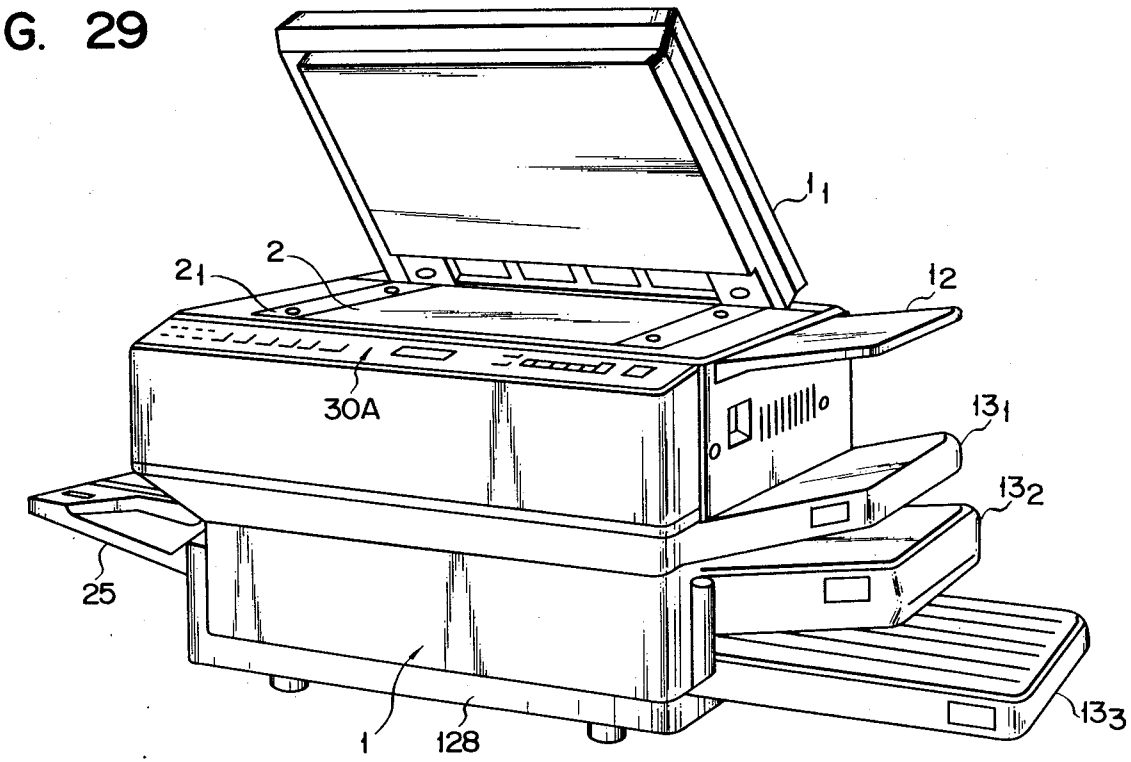

FIGS. 28 and 29 schematically show a copying machine as an image forming apparatus according to a fourth embodiment of the present invention. Reference numeral 1 denotes a copying machine housing. An original table (i.e., a transparent glass) 2 is fixed on the upper surface of the housing 1. An openable original cover $1_1$ and a work table $1_2$ are arranged near the table 2. A fixed scale $2_1$ as a reference for setting an original is arranged at one end of the table 2 along the longitudinal direction thereof.

The original set on the original table 2 is scanned for image exposure as an optical system 3 including an exposure lamp 4 and mirrors 5, 6 and 7 reciprocates in the direction indicated by arrow a along the under surface of the original table 2. In this case, the mirrors 6 and 7 move at a speed half that of the mirror 5 so as to maintain a fixed optical path length.

A reflected light beam from the original scanned by the optical system 3, that is, irradiated by the exposure lamp 4, is reflected by the mirrors 5, 6 and 7, transmitted through a lens block 8 for magnification or reduction, and then reflected by a mirror $9_1$, $9_2$, $9_3$ to be projected on a photosensitive drum 10. Thus, an image of the original is formed on the surface of the photosensitive drum 10.

The photosensitive drum 10 rotates in the direction indicated by arrow c so that its surface is wholly charged first by a main charger 11.

The latent image formed on drum 10 is applied with red or black toner by developing units $12_1$ and $12_2$, which are selectively operated so that the latent image can be produced as a visible image. Meanwhile, sheets (image forming media) P are selectively fed by feed rollers $14_1$, $14_2$ and $14_3$ and roller pairs $15_1$, $15_2$ and $15_3$ from upper, middle and lowe cassettes $13_1$, $13_2$ and $13_3$ one by one. Each sheet is guided to aligning roller pair 19 along guide path $16_1$, $16_2$ and $16_3$ and is fed by pair 19 to the transfer section. It should be noted that cassettes $13_1$, $13_2$ and $13_3$ are detachably attached to the lower portion at the right side of housing 1. One of the cassettes must be selected at the operation panel (to be described later). Sizes of cassettes $13_1$, $13_2$ and $13_3$ are detected by cassette size detection switches $60_1$, $60_2$ and $60_3$, respectively. Switches $60_1$, $60_2$ and $60_3$ comprise a plurality of microswitches which are turned on/off upon the insertion of cassettes of different sizes.

The paper sheet P delivered to the transfer region comes into intimate contact with the surface of the photosensitive drum 10, in the space between a transfer charger 20 and the drum 10. As a result, the toner image on the photosensitive drum 10 is transferred to the paper sheet P by the agency of the charger 20. After the transfer, the paper sheet P is separated from the photosensitive drum 10 by a separation charger 21 and transported by a conveyor belt 22. Thus, the paper sheet P is delivered to a fixing roller pair 23 as a fixing unit arranged at the terminal end portion of the conveyor belt 22. As the paper sheet P passes through the fixing roller pair 23, the transferred image fixed on the sheet P. After the fixation, the paper sheet P is discharged into a tray 25 outside the housing 1 by two exit roller pairs 24, $60_4$.

After the transfer, moreover, the photosensitive drum 10 is de-electrified by a de-electrification charger 26, when the residual toner on the surface of the drum 10 is removed by a cleaner 27. Thereafter, a residual image on the photosensitive drum 10 is erased by a discharge lamp 28 to restore the initial state. In FIG. 2, numeral 29 designates a cooling fan for preventing the temperature inside the housing 1 from rising.

Figure 30:
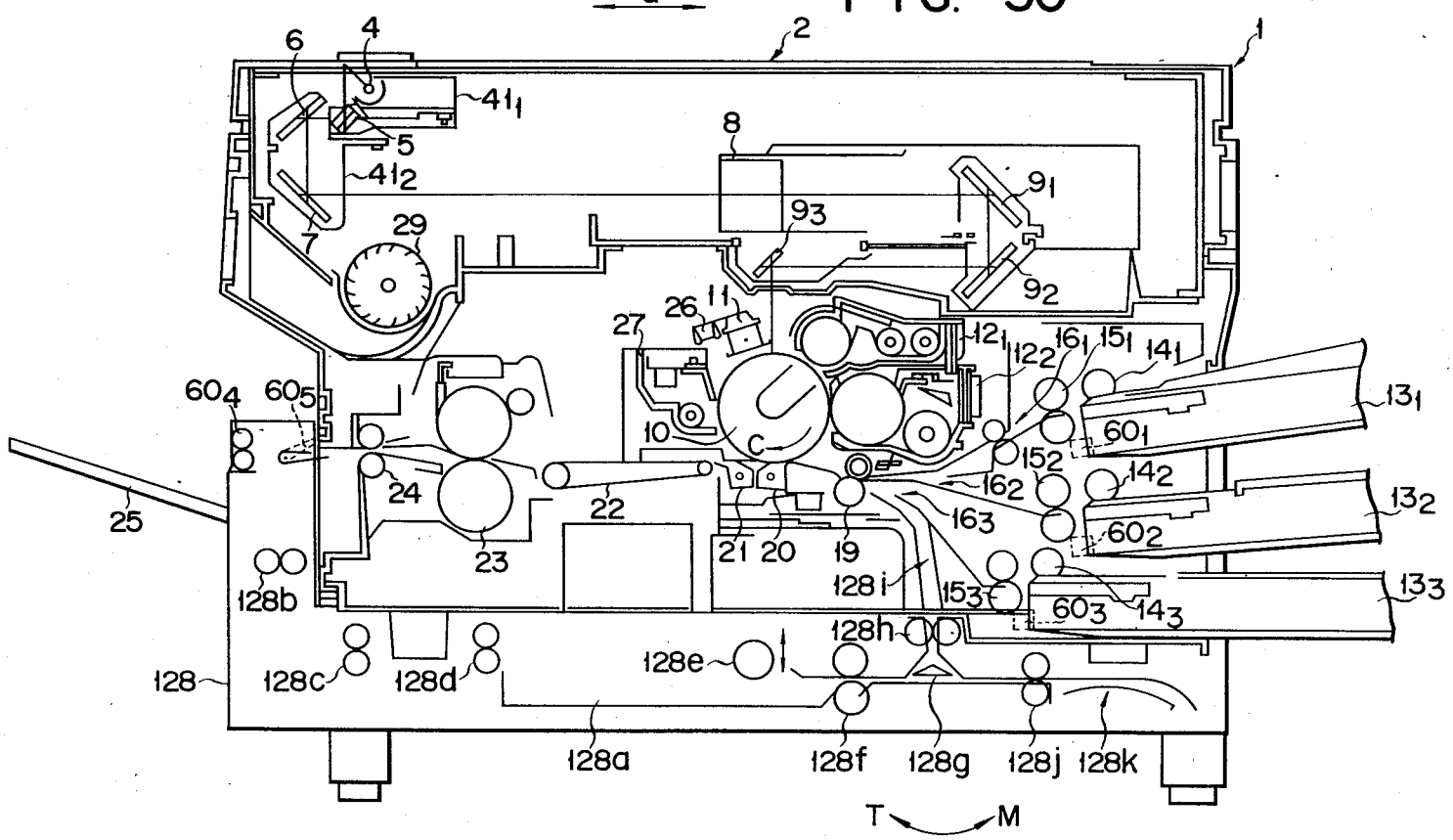

Two-side multicopying unit 128 is arranged at the lower portion of housing 1 to perform two-side copying or multicoying for copying different images on the same sheet surface. Unit 128 has selection gate $60_5$, discharge roller pair $60_4$, and a plurality of roller pairs **128*b*, 128*c* and 128*d* for guiding the sheet from gate $60_5$ to stacking portion 128*a*. Feedout roller 128*e* is arranged in portion 128*a* to feed out the sheets temporarily stacked in portion 128*a*. Roller 128*e* can be moved vertically in the direction of the arrow in accordance with the thickness (number) of stacked sheets. The sheets fed by roller 128*e* are separated by separation roller pair 128*f* one by one, and each sheet is guided to control gate 128*g*. Gate 128*g* is pivoted in the M direction when multicopying is performed, so that the sheet is guided to roller pair 19 through convey roller pair 128*h* along sheet guide path 128*i*. However, when two-side copying is performed, gate 128*g* is set to the position illustrated in FIG. 30, so that the sheet is guided to inverting portion 128*k* through roller pair 128*j*. When the sheet is fed to portion 128*k*, gate 128*g* is pivoted in the T direction, so that it is guided to pair 19 through pair 128*h* along path 128*i***.

Note that in this embodiment, only a multiple copying function of double-side multiple copying unit $60_3$ is used.

Figure 31:
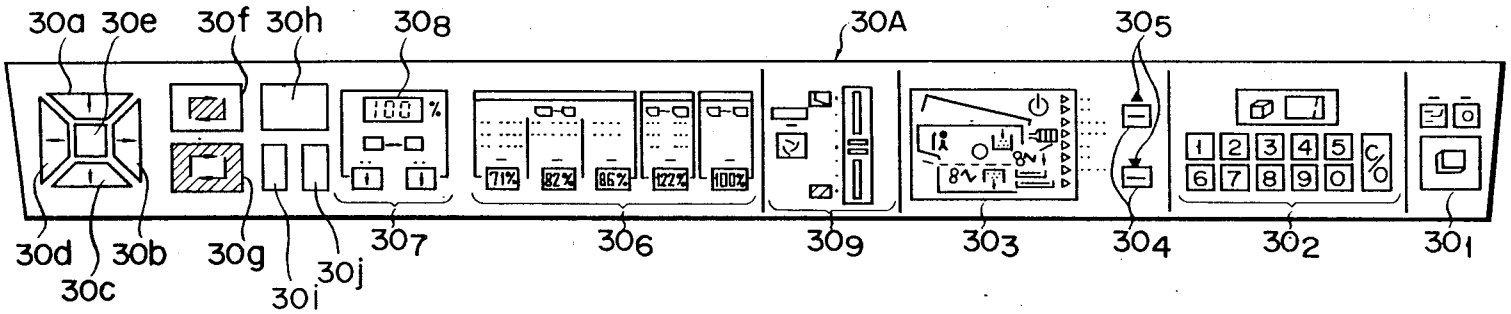

FIG. 31 shows control panel 30A used in the fourth embodiment. Referring to FIG. 31, reference numeral **30*i* denotes a red-designating key for designating developing unit $12_1$ storing red toner; and 30*j***, a black-designating key for designating developing unit $12_2$ storing black toner. The other arrangements are the same as those of the first embodiment.

Figure 32:
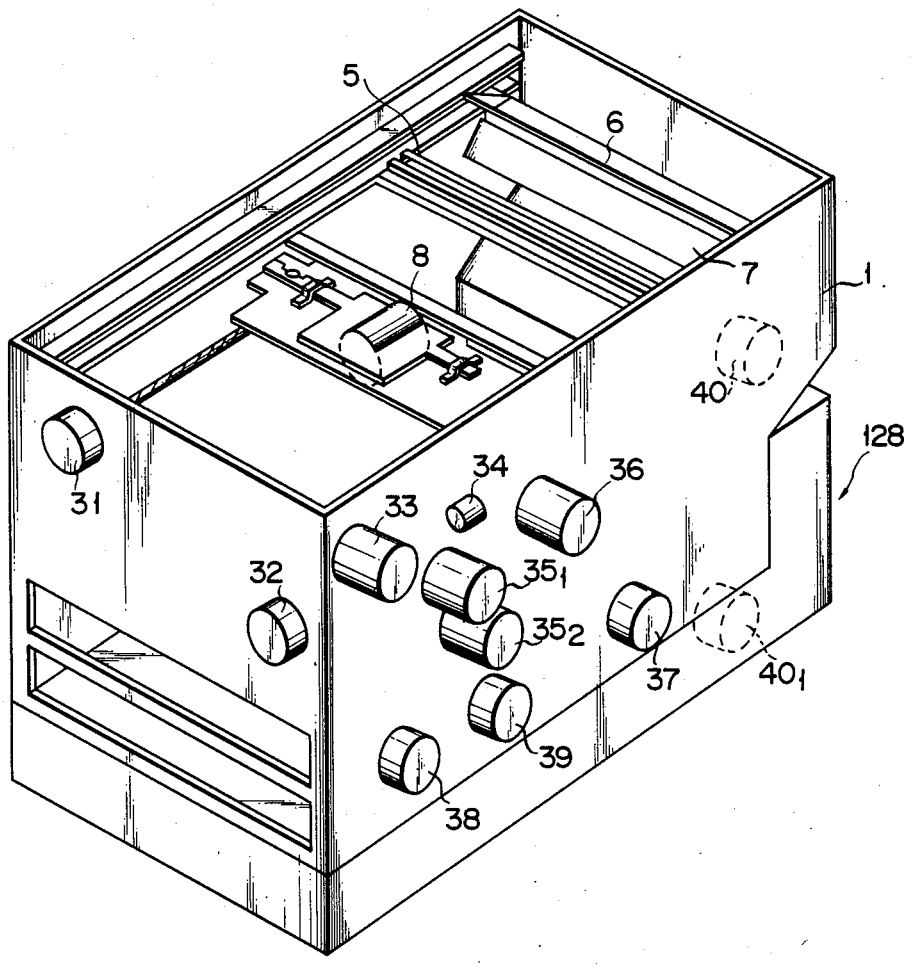

FIG. 32 shows an arrangement of drive sources for respective drive portions used in this embodiment. Referring to FIG. 32, reference numerals $35_1$ and $35_2$ denote developing motors for driving developing rollers of developing units $12_1$ and $12_2$ (not shown); and $40_1$, a motor for driving roller pairs **128*a* to 128*c* and feed roller 128*e*** (not shown). The other arrangements are the same as those of the first embodiment.

A drive mechanism for reciprocating optical system 3 is the same as that of the first embodiment shown in FIG. 5.

Figure 33:
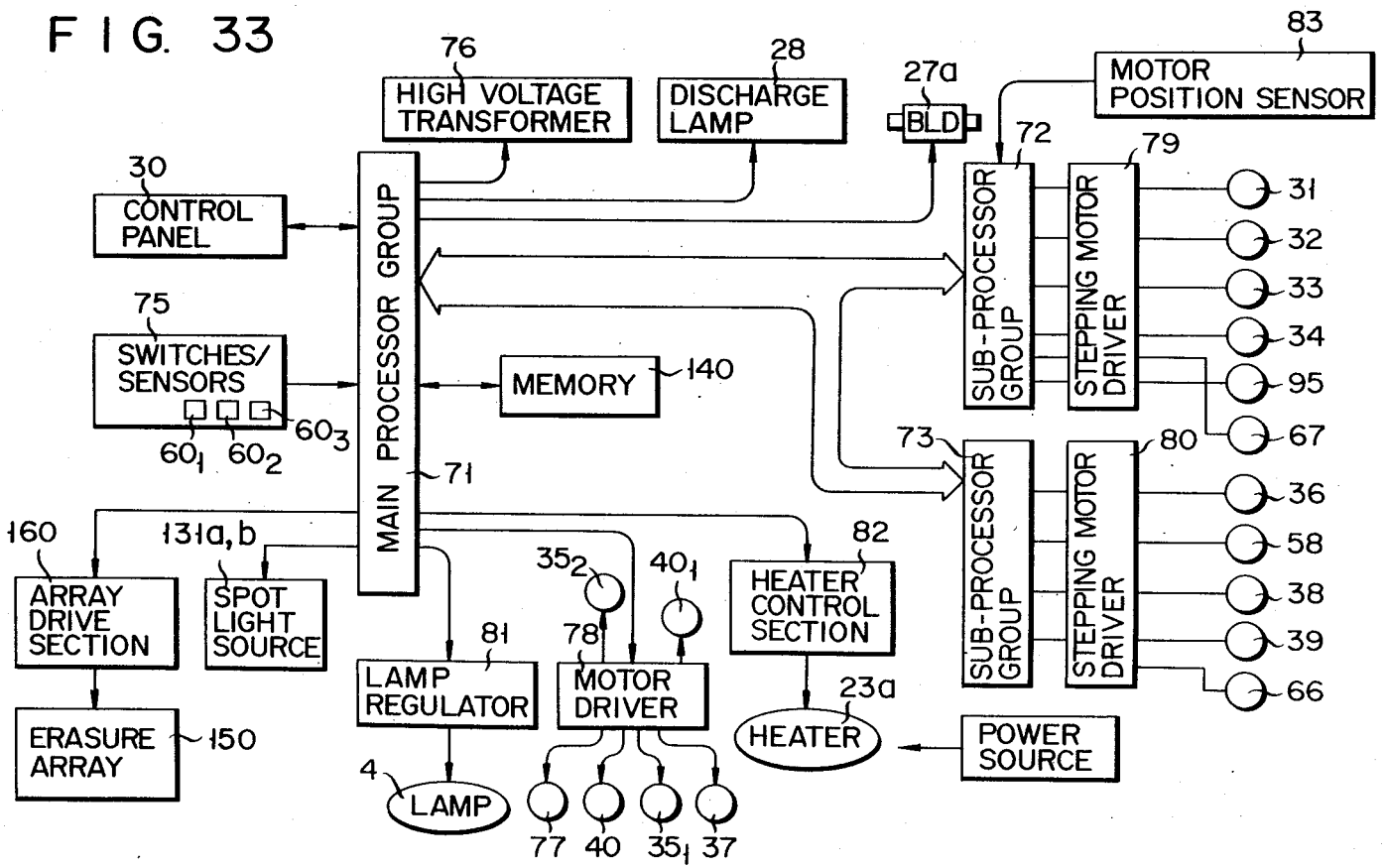

FIG. 33 shows a control circuit used in this embodiment. In FIG. 33, cassette size detection switch $60_3$ is added to switches/sensors 75. Motor driver 78 drives motors $35_1$ and $35_2$ in addition to the other motors. Motor drivers 79 and 80 drive stepping motors 66 and 67 respectively, in addition to the other motors. Therefore, main processor group 71 and subprocessor groups 72 and 73 control other sections upon driving operation of these motors. The apparatus of this embodiment thus has substantially the same arrangement as that of the first embodiment, excluding the control operation of light sources **131*a* and 131*b*** (to be described later).

The arrangement of main processor group 71, and subprocessor groups 72 and 73 are the same as those of the first embodiment shown in FIGS. 8 to 10.

The same motor control circuit and the speed control method as in the first embodiment, shown in FIGS. 11, 12A, and 12B, are adopted in the fourth embodiment.

A method for specifying an unnecessary portion of an original image and an arrangement and method of an erasure means in this embodiment are substantially the same as those of the second embodiment using two spot light sources **131*a* and 131*b*. However, spot light source 131*b* emits the green light beam. Spot light sources 131*a* and 131*b* are continuously illuminated or flash when corresponding with an erasure area inside or outside an erasure area of original G. Light emitting elements 132*a* and 132*b* are illuminated in different colors corresponding to toner colors stored in developing units $12_1$ and $12_2$. More specifically, light emitting element 132*a* emits a red light beam corresponding to developing unit $12_1$ storing red toner, and light emitting element 132*b*** emits a blue light beam corresponding to developing unit $12_2$ storing black toner. Thus, as will be described later, it can be identified that an erasure area specified by a red spot beam corresponds to a red copying operation area, and that area specified by a blue spot beam corresponds to a black copying operation area.

During the setting operation for an erasure area, when original G is to be copied in red and red-designating key **30*i* is depressed, only spot light source 131*a* is illuminated or flashes, and an operator operates keys 30*a* to 30*d* while visually observing the red spot beam transmitted through original G. When original G is to be copied in black and black-designating key 30*j* is depressed, key operation is made with reference to the blue spot beam from light source 131*b***.

After the erasure area is set, it is confirmed by operating check key 30h as follows. When check key **30*h* is operated, main processor group 71 selectively drives first carriage $41_1$ and spot light sources 131*a* and 131*b* in accordance with the erasure area and coordinate positions of a spot beam stored in memory 140**.

For example, when an erasure area is inside an area specified by coordinates S1(x1,y1) and S2(x2,y2), shown in FIG. 24, and a red copying mode is set, a red spot beam is emitted upon depression of red-designating key **30*i*. The erasure area is indicated by a continuously illuminated red spot beam from red spot light source 131*a*. More specifically, spot light source 131*a* is shifted to stored coordinate position S1(x1,y1), and an illumination signal is supplied from main processor group 71 to light emitting element 132*a*, thus turning it on. First carriage $41_1$ is then driven so that spot light source 131*a* is shifted from coordinate position S1(x1,y1) to (x2,y1), and from (x2,y1) to S2(x2,y2). Thereafter, first carriage $41_1$ is driven so that light source 131*a* is shifted from position S2(x2,y2) to (xl,y2), and finally, back to S1(x1,y1). When spot light source 131*a*** is thus continuously illuminated and shifted, it can be confirmed that the erasure area is inside the indicated area, and that a red copying mode is set.

On the other hand, when an erasure area is outside the area specified by coordinates S1(x1,y1) and S2(x1,y2), and a black copying mode is set, a blue spot beam flashes upon depression of black designating key 30*j*, and the erasure area is indicated using flashing blue spot light source 131*b*. In this case, since light source 131*b* is separated from light souce 131*a* specifying the erasure area at distance l in the x direction, the x coordinates of of positions S1 and S2 are corrected by distance l. Light source 131b is shifted to a position corresponding to corrected position S1(x1,y1), based on the corrected coordinates. In this state, an illumination signal is generated from main processor group 71, and light emitting element 132*b* is turned on. Thereafter, light source 131*b* is shifted in the directions indicated by arrows in FIG. 24, in the same manner as above, and the erasure area is indicated by the flashing blue spot beam. When light source 131*b* is thus illuminated and shifted, it confirms that the erasure area is outside the indicated area and that the black copying mode is set.

According to the fourth embodiment, spot light sources 131*a* and 131*b* for emitting spot beams of different colors are mounted on first carriage $41_1$. When the red or black copying mode is set, the erasure area inside or outside the indicated area is specified by continuously illuminated or flashing light sources 131*a* and 131*b*, and an original image inside or outside the specified area is erased during the image forming operation. Thereby, an unnecessary portion of an original can be selectively erased, resulting in convenience and efficiency in copying.

A specified erasure area is thus indicated on an original by shifting illuminating or flashing spot light source 131*a* or 131*b* on it. In addition, it is determined by reference to the colors of spot beams and their illuminated state (i.e., if they are continuously on or flash) whether the erasure area is inside or outside the indicated area, and whether the black or red copying mode has been selected. Therefore, the erasure area and copying color can be reliably checked.

Figure 19B:
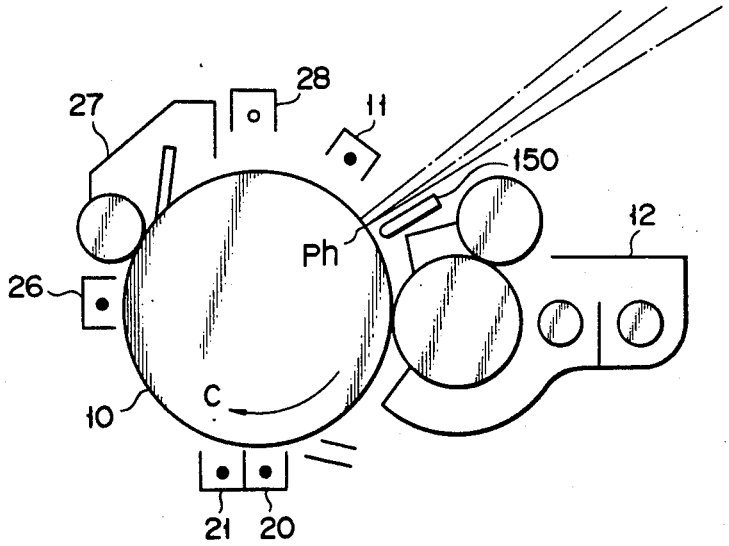

The present invention is not limited to the above embodiments. Erasure array 150 need not be interposed between charger 11 and exposure section $P_h$, as shown in FIG. 19A, but can be interposed between exposure section $P_h$ and developing unit 12, as shown in FIG. 19B, so that a latent image formed is erased in accordance with erasure area designation.

The capacity of memory 140 can be changed if needed.

Furthermore, when an erasure area of an original is specified, the original is set at the side of scale $2_1$. However, the original can also be set at the side of scale $2_2$.

What is claimed is:

1. An image forming apparatus with area selection and confirmation, said apparatus comprising:

an original table on which a light-transmitting original is placed;

transmission light emitting means, provided movably along said original table, for emitting transmission light through the original placed on said original table;

erasure area specifying means for shifting the light emitted from said transmission light emitting means to an unnecessary portion of the original so as to specify a portion to be erased;

erasure area storage means for storing position data indicating the erasure portion specified by said erasure area specifying means;

checking operation designating means for designating a predetermined checking operation including confirmation of the erasure area specified by said erasure area specifying means;

first control means for reading out the position data stored in said erasure area storage means upon designation of said checking operation designating means and for supplying to said transmission light emitting means a control signal for the predetermined checking operation, including confirmation of the specified erasure area based on the readout position data;

original scanning means, having an optical system moved along said original table, for optically scanning the original placed on said original table;

image forming means for forming and developing an optical image of light reflected from the original by said original scanning means so as to form an image on an image forming medium;

image erasing means for selectively erasing an image to be formed by said image forming means; and second control means for reading out the position data stored in said erasure area storage means during an image forming operation of said image forming means so as to supply the readout data to said image erasing means.

2. An apparatus according to claim 1, wherein said transmission light emitting means includes a light-emitting element and a lens which are arranged to be movable with respect to said original scanning means along a direction perpendicular to a moving direction of said original scanning means, said light-emitting element and said lens being arranged to form spot light as the transmission light.

3. An apparatus according to claim 1, wherein said erasure area specifying means includes means for calculating the position data corresponding to a position of the original which represents a specified erasure area.

4. An apparatus according to claim 1, wherein said image erasing means includes a plurality of light-emitting elements linearly arranged so as to oppose said image forming means.

5. An apparatus according to claim 4, wherein said plurality of light-emitting elements are located at positions subjected to selective light emission to said image forming means during focusing by said image forming means.

6. An apparatus according to claim 4, wherein said plurality of light-emitting elements are located at positions subjected to selective light emission to said image forming means during development by said image forming means.

7. An apparatus according to claim 1, wherein said transmission light emitting means can shift light beams of a plurality of colors on the placed original; and said erasure area specifying means specifies the erasure area so that one of the light beams of one of the plurality of colors corresponds to a first area inside a specified area or a second area outside the specified area, and said first control means supplies to said transmission light emitting means a control signal for indicating the first or second area of the specified erasure area by using the light beam of the corresponding color in order to confirm the erasure area.

8. An apparatus according to claim 7, wherein said transmission light emitting means includes a plurality of lenses and light-emitting elements for emitting spot beams of different colors, which are provided on said original scanning means to be movable in a direction perpendicular to a moving direction of said original scanning means, and to be parallel to each other.

9. An apparatus according to claim 7, wherein said transmission light emitting means includes a plurality of lenses and light-emitting elements for emitting spot beams of different colors, which are provided on said original scanning means to be movable in a direction perpendicular to a moving direction of said original scanning means and to be perpendicular to each other.

10. An apparatus according to claim 1, wherein said apparatus further comprises image forming color designating means for designating an image forming color from a plurality of image forming colors; and said transmission light emitting means can shift light beams of a plurality of colors on the placed original, said erasure area specifying means specifies the erasure area so that one of the light beams of one of the plurality of colors corresponds to a first area inside a specified area or a second area outside the specified area and to the image forming color designated by said image forming color designating means, said first control means supplies to said transmission light emitting means a control signal for indicating the first or second area of the specified erasure area using the light beam of the corresponding color in order to confirm the erasure area and the designated image forming color, and said image forming means selectively drives a plurality of developing units upon designation of said image forming color designating means.

11. An apparatus according to claim 10, wherein said transmission light emitting means includes a light-emitting element and a lens which are arranged to be movable with respect to said original scanning means along a direction perpendicular to a moving direction of said original scanning means, said light-emitting element and said lens being arranged to form spot light as the transmission ight.

12. An apparatus according to claim 11, wherein said erasure area specifying means includes means for calculating the position data corresponding to a position of the original which represents a specified erasure area.

* * * * *